US006567062B1

(12) United States Patent
Kudo et al.

(10) Patent No.: US 6,567,062 B1
(45) Date of Patent: May 20, 2003

(54) LIQUID CRYSTAL DISPLAY APPARATUS AND LIQUID CRYSTAL DISPLAY DRIVING METHOD

(75) Inventors: Yasuyuki Kudo, Kamakura (JP); Tsutomu Furuhashi, Yokohama (JP); Toshio Miyazawa, Chiba (JP); Yoshiro Mikami, Hitachiota (JP); Hajime Akimoto, Ome (JP); Norio Manba, Fujisawa (JP)

(73) Assignee: Hitachi, Ltd., Tokyo (JP)

( * ) Notice: Subject to any disclaimer, the term of this patent is extended or adjusted under 35 U.S.C. 154(b) by 192 days.

(21) Appl. No.: 09/654,388

(22) Filed: Sep. 1, 2000

(30) Foreign Application Priority Data

Sep. 13, 1999 (JP) ..... 11-259393

(51) Int. Cl.[7] ..... G09G 3/36
(52) U.S. Cl. ..... 345/92; 345/89
(58) Field of Search ..... 345/87, 92, 88, 345/89, 90, 94, 96, 98, 100; 349/42, 43, 46, 47, 33, 41

(56) References Cited

U.S. PATENT DOCUMENTS 3,896,318 A * 7/1975 Mitsui ..... 250/331
4,717,244 A * 1/1988 Hilsum et al. ..... 345/92
4,818,981 A * 4/1989 Oki et al. ..... 345/205
5,489,918 A 2/1996 Mosier
5,796,379 A * 8/1998 Enomoto et al. ..... 345/100
5,900,854 A * 5/1999 Itoh et al. ..... 345/92
5,945,970 A * 8/1999 Moon et al. ..... 345/211
6,342,881 B1 * 1/2002 Inoue ..... 345/204

FOREIGN PATENT DOCUMENTS

JP 9-160073 6/1997
JP 10-54998 2/1998

OTHER PUBLICATIONS

"Development of Super–TFT–LCDs with In–Plane Switching Display Mode", M. Ohta, et al, Electron Tube & Devices Div., Hitachi, Ltd., Asia Display '95, pp. 707–710.

* cited by examiner

*Primary Examiner*—Chanh Nguyen
(74) *Attorney, Agent, or Firm*—Antonelli, Terry, Stout & Kraus, LLP

(57) ABSTRACT

An active matrix type liquid crystal display apparatus includes: a plurality of common electrodes and a plurality of gate electrodes, both of which are intersected respectively, and a plurality of drain electrodes in parallel with the common electrodes, formed on one of inner surfaces of two substrates oppositely arranged through a liquid crystal layer; a display pixel unit having a plurality of pixels, each of which includes three-terminal switching element and a liquid crystal cell at each of intersection points of the plurality of common electrodes and the plurality of gate electrodes; and a peripheral circuit for applying a predetermined voltage to each of the common electrodes, the gate electrode and the drain electrode, wherein a first terminal of the switching element is connected to the drain electrode, a second terminal of the switching element is connected to the liquid crystal cell, an opposite side of which is connected to the common electrode, a third terminal of the switching element is connected to the gate electrode.

6 Claims, 14 Drawing Sheets

LIQUID CRYSTAL DISPLAY APPARATUS AND LIQUID CRYSTAL DISPLAY DRIVING METHOD

BACKGROUND OF THE INVENTION

1. Field of the Invention

The present invention relates to an active matrix type liquid crystal display apparatus and a driving method therefor.

2. Description of the Related Art

The active matrix type liquid crystal display apparatus controls a transmittance (luminance) of each pixel by a RMS value of a voltage applied thereto. In this liquid crystal display apparatus, as illustrated in FIG. 2, one pixel includes one MOS type transistor. Moreover, the gate is connected to a gate electrode that the pixels in a transverse direction include in common, and the drain is connected to a drain electrode that the pixels in a longitudinal direction include in common. Also, the source is connected to a common electrode that all the pixels include in common and that is positioned on the side opposite to the source with a liquid crystal cell located in between. As illustrated in FIG. 3, the driving method for the display apparatus is as follows: An active state (in FIG. 3, "high") of a scan line signal, which indicates a scan line to be scanned, is applied to each of the gate electrodes in time-division. In accordance with gray-scale information of display data on the line the scan line signal of which is switched into the active state, a one-level gray-scale voltage is selected out of a plurality of levels, then being applied to the drain electrode. Also, a voltage becoming the reference is applied to the common electrode. This procedure holds, in the respective liquid crystal cells in the line sequence, a gray-scale voltage to be applied at the end of a gate-on state. Namely, it becomes possible to control the applied RMS voltage (luminance) to each pixel in correspondence with display data.

Also, as another driving method, there exists a method disclosed in JP-A-10-54998. In this method, as illustrated in FIG. 4, one pixel includes two MOS transistors. For example, in the first MOS transistor, the gate is connected to the first gate electrode that the pixels in a longitudinal direction include in common, and the drain is connected to a drain electrode that all the pixels include in common, and the source is connected to a drain of the second MOS transistor. Also, in the second MOS transistor, the gate is connected to the second gate electrode that the pixels in a transverse direction include in common, and the source is connected to a common electrode that all the pixels include in common and that is positioned on the side opposite to the source with a liquid crystal cell located in between. As illustrated in FIG. 5, the driving method is as follows: An active state (in FIG. 5, "high") of a scan line signal, which indicates a scan line to be scanned, is applied to each of the second gate electrodes in time-division. In accordance with gray-scale information of display data on the scan line, a gray-scale voltage control signal with a pulse-width corresponding to the gray-scale information is applied to the first gate electrode. Furthermore, a gray-scale voltage, which is in synchronization with a scanning time-period for one line and has, for example, a ramp waveform, is applied to the drain electrode. Also, a voltage becoming the reference is applied to the common electrode. This procedure holds, in the respective liquid crystal cells in the line sequence, a gray-scale voltage level to be reached at the end of a state where the first and the second gates becomes gate-on simultaneously. Accordingly, as is the case with the former method, it becomes possible to control the applied RMS voltage to each pixel in correspondence with display data.

In the method described earlier, as the number of gray-scales (the number of colors) to be displayed is increased, the number of levels of a gray-scale voltage to be prepared is increased. This condition has resulted in increases in the numbers of gray-scale voltage generating output amplifiers and of gray-scale voltage selecting switches, thereby bringing about a problem of a rising in the cost.

Also, for example, if the above-described method is applied to the liquid crystal display apparatus where peripheral driving circuits and the pixels are formed integrally, it turns out that the above-described output amplifiers and selecting switches are also formed in portions of the peripheral driving circuits. This has resulted in a problem that a variation in the characteristics of these elements gives rise to a deterioration in the picture quality.

Also, in the method described later, the pulse-width of the gray-scale voltage control signal makes it possible to control the transmittance of each liquid crystal cell. This brings about an advantage that, even if the number of gray-scales is increased, there is little increase in the circuit scale. Moreover, since all the peripheral circuits can be configured using digital circuits, there exists an effect of suppressing the above-described variation. In this method, however, two MOS transistors are located within one pixel. This condition causes new problems to occur, such as a decrease in the pixel transmittance and a decrease in the yield.

SUMMARY OF THE INVENTION

It is an object of the present invention to provide the active matrix type liquid crystal display apparatus and the driving method therefor, the liquid crystal display apparatus making it possible to prevent the deterioration in the picture quality caused by the inconsistency in the characteristics of the circuit elements.

In solving the above-described problems, at first, let's consider the operation of the MOS transistor in the pixel: In the case where the MOS transistor is of, for example, N type, if an electric potential of the gate is higher than that of the source by the amount of a fixed value or more, the gate is switched into the ON state and thus an electric current is caused to flow between the drain and the source. As a result, a voltage between the drain electrode and the common electrode is applied to the liquid crystal cell. Meanwhile, if the electric potential of the gate is lower than those of the source and the drain, the gate is switched into the OFF state and thus no electric current is caused to flow between the drain and the source. As a result, the voltage that has been applied to the liquid crystal cell at the time of the gate-on is held thereto.

Taking advantage of this operational characteristic in the present invention, gates in pixels on a scan line to be scanned are switched ON and gates in pixels existing on non-scan lines other than the scan line are switched OFF, thereby allowing the line sequence scanning to be executed.

Meanwhile, in the above-described method disclosed in JP-A-10-54998 as well where the gray-scale voltage control signal with the pulse-width in accordance with the gray-scale information is applied to the gate electrode, it is required to perform the control of applying the gray-scale voltage only to the pixels existing on the scan line to be scanned. For this purpose, the second MOS transistor is employed, which allows this control to be implemented.

However, even if the second MOS transistor is not employed, in the following manner for example, it is possible to apply the gray-scale voltage only to the pixels existing on the scan line: The common electrodes are separated in such a manner that they correspond to each of the transverse lines. Then, an electric potential at which the gray-scale voltage control signal is "high" and the gates are switched into the ON state is provided to the common electrodes existing on the scan line to be scanned. Moreover, an electric potential that is higher than the electric potential at which the gray-scale voltage control signal is "high" is provided to the drain electrodes and the common electrodes existing on the non-scan lines other than the scan line.

In view of the above-described points, the present invention implements an active matrix type liquid crystal display apparatus utilizing the pulse-width, and a driving method therefor.

Namely, the liquid crystal display apparatus according to the present invention is characterized by the following: One pixel includes one MOS type transistor of, for example, N type. Moreover, the gate is connected to a gate electrode that the pixels in a longitudinal direction include in common, and the drain is connected to a drain electrode that the pixels in a transverse direction include in common. Also, the source is connected to a common electrode that the pixels in the transverse direction include in common and that is positioned on the side opposite to the source with a liquid crystal cell located in between.

The driving method for the liquid crystal display apparatus according to the present invention is as follows: An active state of a scan line signal, which indicates a scan line to be scanned, is applied to each of the common electrodes in time-division. In accordance with gray-scale information of display data on the scan line, a gray-scale voltage control signal with a pulse-width corresponding to the gray-scale information is applied to the gate electrode.

Here, in the case where the MOS transistor is of N type, the active state of the scan line signal is "low" and the electric potential thereof is equal to an electric potential at which the gray-scale voltage control signal is "high" and the gate in the MOS transistor is switched into the ON state. Also, a non-active state of the scan line signal is "high" and the electric potential thereof is higher than the electric potential at which the gray-scale voltage control signal is "high".

Meanwhile, in the case where the MOS transistor is of P type, the active state of the scan line signal is "high" and the electric potential thereof is equal to an electric potential at which the gray-scale voltage control signal is "low" and the gate in the MOS transistor is switched into the ON state. Also, the non-active state of the scan line signal is "low" and the electric potential thereof is lower than the electric potential at which the gray-scale voltage control signal is "low".

Furthermore, the same electric potential as those of the "high" and the "low" states of the scan line signal which, are applied to the same pixel is defined as a reference electric potential of a gray-scale voltage applied to the above-described drain electrode.

As described above, according to the active matrix type liquid crystal display apparatus in the present invention and the driving method therefor, one MOS transistor is located within one pixel, and the pulse-width of the gray-scale voltage control signal makes it possible to control the transmittance of each liquid crystal cell.

Further, the present invention is characterized by an active matrix type liquid crystal display apparatus including, on an inner surface of one of two substrates that are oppositely located with a liquid crystal layer placed therebetween, a plurality of common electrodes and a plurality of gate electrodes intersecting to each other, and a plurality of drain electrodes arranged in parallel to the common electrodes, and a display pixel unit having a plurality of pixels, each of the plurality of pixels including a three-terminal switching element and a liquid crystal cell at each of intersection points of the plurality of common electrodes and the plurality of gate electrodes. Herein, the first terminal of each switching element is connected to each drain electrode, the second terminal of each switching element being connected to each liquid crystal cell the opposite side of which is connected to each common electrode, the third terminal of each switching element being connected to each gate electrode. In the active matrix type liquid crystal display apparatus, each switching element is switched into the ON state when an electric potential difference between a voltage applied to each gate electrode and a voltage applied to each common electrode becomes equal to a specific defined value. Moreover, in the ON state of each switching element, an electric potential difference between a voltage applied to each drain electrode and the voltage applied to each common electrode is applied to each liquid crystal cell. Furthermore, an electric potential difference applied at the end of the ON state is held until the next ON state.

Here, the above-described active matrix type liquid crystal display apparatus further includes a peripheral circuit. Here, the peripheral circuit includes a scan signal driving circuit for applying an active state of a scan line signal to each common electrode in sequence on one scanning time-period basis, the scan line signal indicating a scan line to be scanned, a gray-scale voltage circuit for applying a gray-scale voltage to each drain electrode, and a data signal driving circuit for applying a gray-scale voltage control signal with a pulse-width corresponding to the gray-scale information of display data of a pixel applied by an active state of scanning line signal to the gate electrode. Moreover, it is preferable that the gray-scale voltage circuit includes a voltage waveform generating circuit for generating a voltage the waveform of which is varied with a lapse of time with a predetermined characteristic, and a plurality of gray-scale voltage selecting circuits located for each scan line for applying, to each drain electrode, the voltage waveform generated by the voltage waveform generating circuit, the gray-scale voltage selecting circuits applying the voltage waveform only for a time-period corresponding to the pulse-width of the gray-scale voltage control signal in the case where the scan line to be scanned has been selected.

Further, it is preferable that the above-described display pixel unit and the above-described peripheral circuit be formed integrally on one and the same substrate of the two substrates.

Still further, the present invention is characterized by a driving method of driving an active matrix type liquid crystal display apparatus, the active matrix type liquid crystal display apparatus including, on an inner surface of one of two substrates that are oppositely located with a liquid crystal layer placed therebetween, a plurality of common electrodes and a plurality of gate electrodes intersecting to each other, and a plurality of drain electrodes arranged in parallel to the common electrodes, and a plurality of pixels, each of the plurality of pixels including a three-terminal switching element and a liquid crystal cell at each of intersection points of the plurality of common electrodes and the plurality of gate electrodes. Here, the driving method including the steps of connecting the first terminal of each switching element to each drain electrode, connecting the second terminal of each switching element to each liquid crystal cell the opposite side of which is connected to each common electrode, connecting the third terminal of each switching element to each gate electrode, applying an active state of a scan line signal to each common electrode in sequence on one scanning time-period basis, the scan line signal indicating a scan line to be scanned, applying a gray-scale voltage to each drain electrode, a reference electric potential of the gray-scale voltage being defined as an electric potential that is the same as electric potentials of the active state and a non-active state of the scan line signal which are applied to one and the same pixel, and complying with gray-scale information of display data of a pixel so as to apply, to each gate electrode, a gray-scale voltage control signal with a pulse-width corresponding to the gray-scale information, the active state of the scan line signal being applied to the pixel.

Here, the following configuration may be allowable: The gray-scale voltage applied to each drain electrode exhibits a polarity with reference to the reference electric potential, the polarity in the first half of the one scanning time-period being different from that in the second half of the one scanning time-period. In addition, the driving method further includes a step of generating, with a time-period employed as a target, the pulse-width of the gray-scale voltage control signal applied to each gate electrode, the time-period being either the first half or the second half of the one scanning time-period, the time-period employed as the target differing between the gate electrodes adjacent to each other.

Further, the following configuration may be allowable: The driving method further includes the steps of providing electric potentials of active states of two types as the scan line signal applied to each common electrode, and applying the electric potentials of the two types for each line alternately.

Further, it is preferable that the above-described gray-scale voltage be of either a ramp waveform or a waveform, the waveform having a preset characteristic curve that corresponds to characteristics such as an applied voltage-transmittance characteristic ($\gamma$ characteristic) of the liquid crystal cell.

Still further, the following configuration may be allowable: The driving method further includes the steps of providing, as the gray-scale voltage, two types of symmetrical waveforms that vary from the reference electric potential into a direction of a positive polarity and that of a negative polarity, outputting the two types of waveforms every one scanning time-period alternately, and when an attention is focused on a certain one scanning time-period in one frame, outputting the two types of waveforms every one frame alternately, the electric potential being maintained to be constant in the beginning time-period and the ending time-period of the one scanning time-period.

Further, it is preferable to set an electric potential in advance so that the transmittance of the liquid crystal cell becomes its maximum or minimum, the above-described gray-scale voltage attaining to the electric potential at the end of the one scanning time-period from the reference electric potential.

Still further, the present invention is characterized by a data signal driving circuit for receiving, as inputs, display data, a signal in synchronization with: the display data, a signal in synchronization with one scanning time-period, and a signal for indicating an effective time-period of the display data, and for converting gray-scale information of the display data into pulse-width information so as to output the pulse-width information toward a plurality of channels, the data signal driving circuit including a latch circuit for fetching the display data by the amount of one line, a data pulse generating circuit for generating different types of pulse-width signals the number of which corresponds to the number of gray-scales of the display data, a reference clock generating circuit for generating a reference clock of the pulse-width signals, a data pulse selector for selecting a single pulse-width signal from the pulse-width signal group by the number of the gray-scales in accordance with the gray-scale information of the display data to output the single pulse-width therefrom, and an output buffer for converting electric potentials of "high" and "low" of the pulse-width signal into predetermined electric potentials so as to output the predetermined electric potentials as gray-scale voltage control signals, the pulse-width signal being outputted by the data pulse selector.

Further, the following configuration may be allowable: The above-described data signal driving circuit includes a latch circuit for fetching the display data by the amount of one line, a data pulse generating circuit for generating, for each odd number channel or even number channel, different types of pulse-width signals the number of which corresponds to the number of gray-scales of the display data, a reference clock generating circuit for generating a reference clock of the pulse-width signals, a data pulse selector for the odd number channels for selecting a single pulse-width signal from the pulse-width signal group for the odd number channels by the number of the gray-scales in accordance with the gray-scale information of the display data to output the single pulse-width signal therefrom, a data pulse selector for the even number channels for selecting a single pulse-width signal from the pulse-width signal group for the even channels by the number of the gray-scales in accordance with the gray-scale information of the display data to output the single pulse-width signal therefrom, and an output buffer for converting electric potentials of "high" and "low" of the pulse-width signal into desired electric potentials so as to output the desired electric potentials as gray-scale voltage control signals, the pulse-width signal being outputted by the data pulse selector for the odd number channels or the data pulse selector for the even number channels. Here, the data signal driving circuit is characterized by the following condition: The pulse-width signal for the odd number channels is generated with the second half of the one scanning time-period employed as a target, and the pulse-width signal for the even number channels is generated with the first half of the one scanning time-period employed as the target. Otherwise, the condition providing the inverse relationship is presented.

Still further, the following configuration may be allowable: The above-described data signal driving circuit includes an output channel selector for specifying a channel receiving the output, a data pulse converting circuit for converting in sequence the display data into the pulse-width signal, a reference clock generating circuit for generating a reference clock of the pulse-width signal, an output control circuit for outputting the pulse-width signal to the channel specified by the output channel selector, and an output buffer for converting electric potentials of "high" and "low" of the pulse-width signal into desired electric potentials so as to output the desired electric potentials as gray-scale voltage control signals, the pulse-width signal being outputted by the output control circuit.

Here, it is preferable that the above-described pulse-width of the pulse-width signal be set in compliance with the applied voltage-transmittance characteristic of the liquid crystal cell as well as with the gray-scale information of the display data.

DESCRIPTION OF THE EMBODIMENTS

Figure 1:
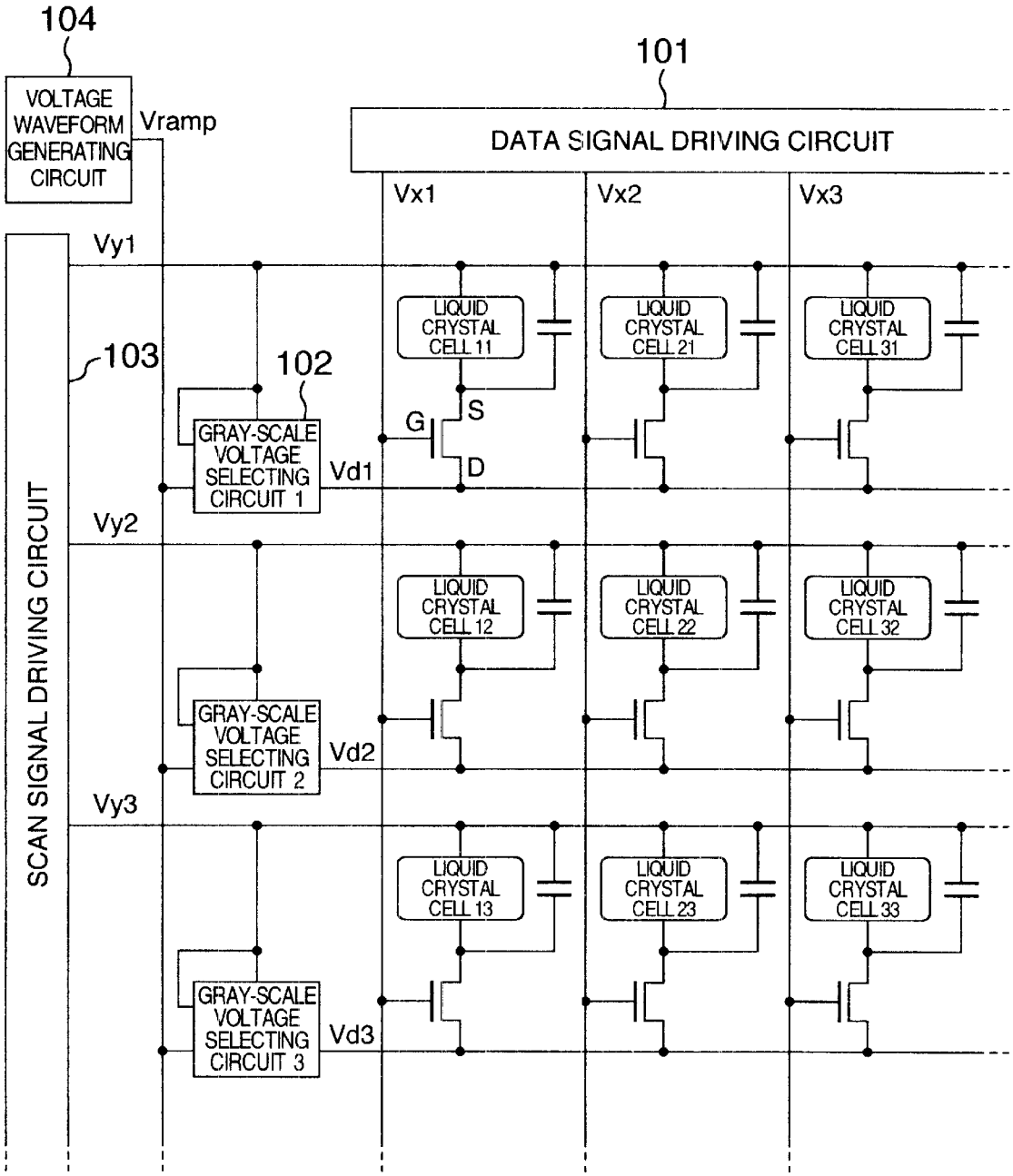
FIG. 1 is a block diagram for illustrating the pixel configuration of a liquid crystal display apparatus related to the first embodiment according to the present invention.
Figure 2:
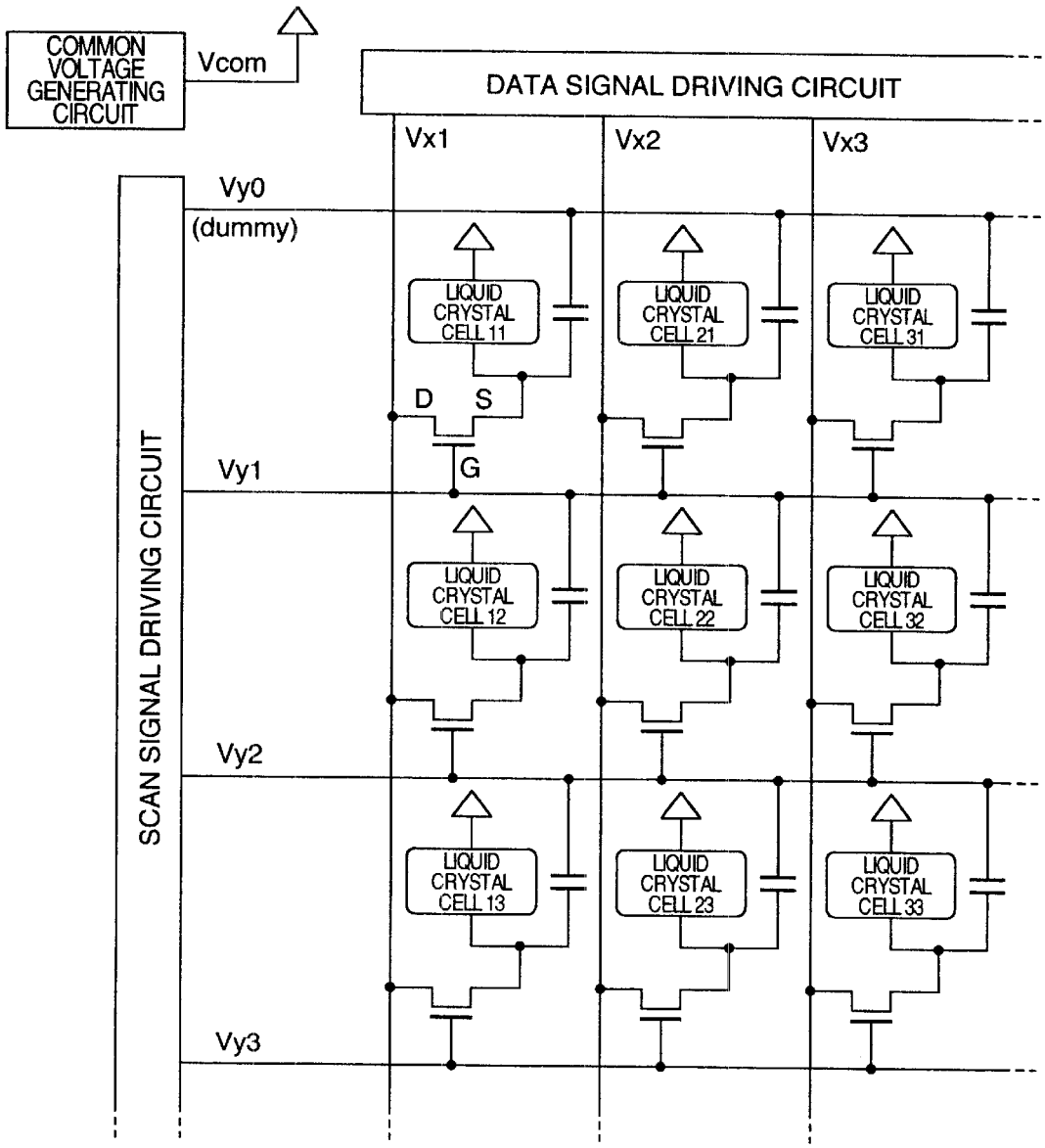
FIG.2 (PRIOR ART)
FIG. 2 is a block diagram for illustrating the pixel configuration of a liquid crystal display apparatus according to a related art.
Figure 3:
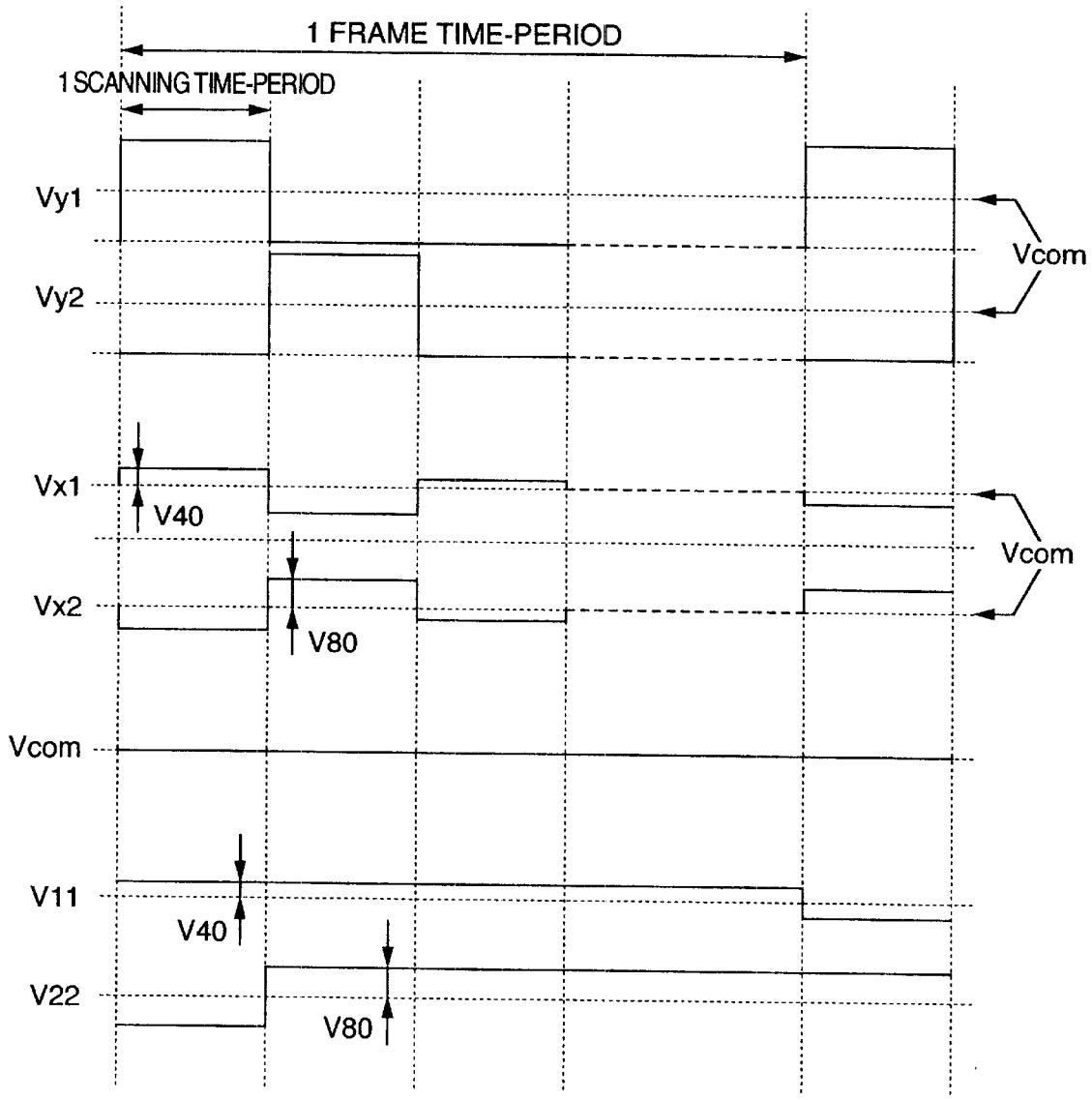
FIG.3 (PRIOR ART)
FIG. 3 is a timing chart for illustrating a driving method for the liquid crystal display apparatus according to the related art.
Figure 4:
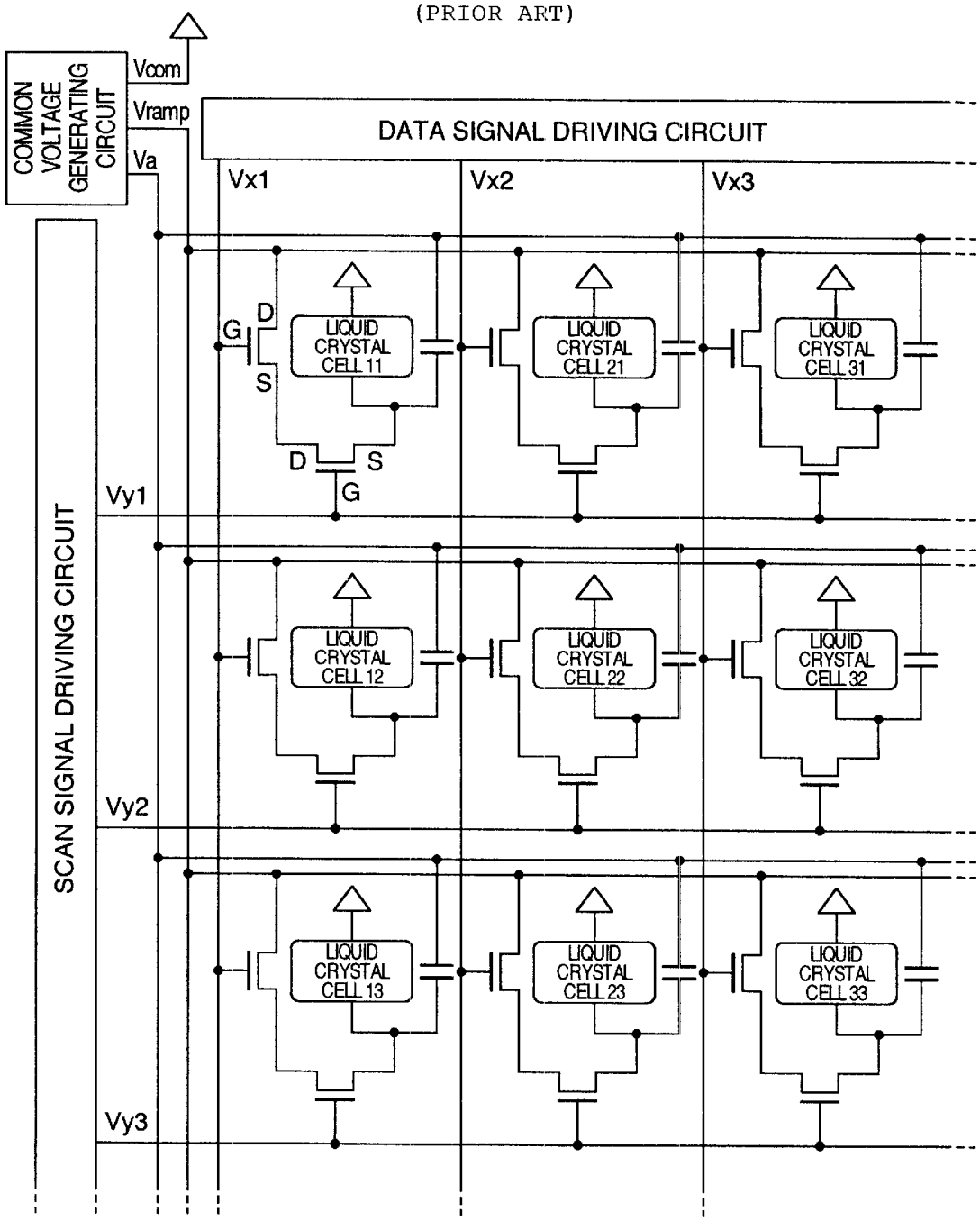
FIG.4 (PRIOR ART)
FIG. 4 is a block diagram for illustrating the pixel configuration of a liquid crystal display apparatus according to the related art.
Figure 5:
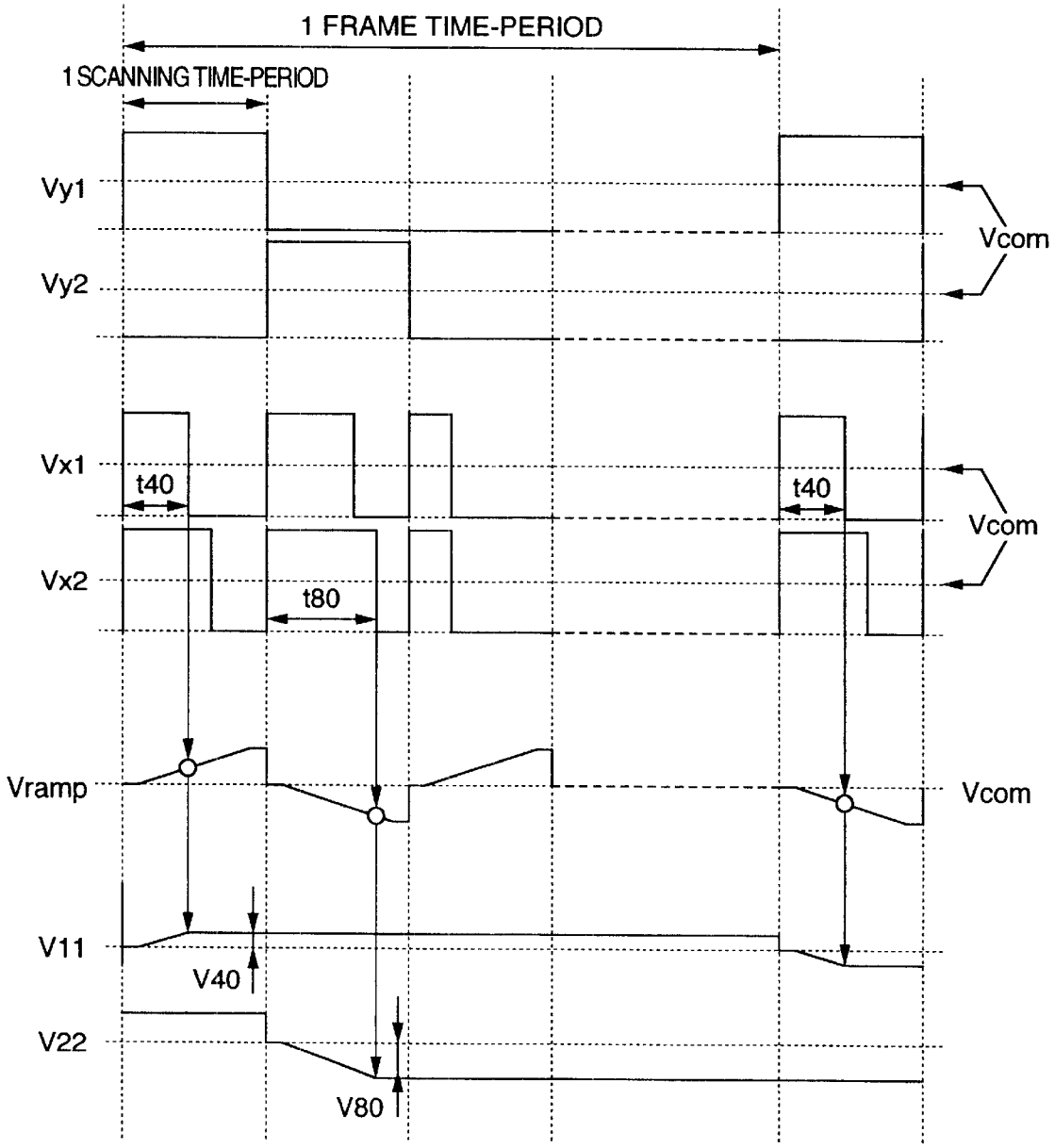
FIG.5 (PRIOR ART)
FIG. 5 is a timing chart for illustrating a driving method for the liquid crystal display apparatus according to the related art.

Hereinafter, referring to FIG. 1 and FIGS. 6 to 8, the explanation will be given concerning the first embodiment according to the present invention. FIG. 1 is a diagram for illustrating the configuration of an active matrix type liquid crystal display apparatus related to the first embodiment according to the present invention.

Each pixel in the present embodiment includes one MOS transistor of, for example, N type. Moreover, each gate is connected to a gate electrode that the pixels in a longitudinal direction include in common, and each drain is connected to a drain electrode that the pixels in a transverse direction include in common. Also, each source is connected to a common electrode that the pixels in the transverse direction include in common and that is positioned on the side opposite to each source with each liquid crystal cell located in between.

Gray-scale voltage control signals (Vx1, Vx2, • • •) outputted by a data signal driving circuit 101 are applied to the gate electrodes. Gray-scale voltages (Vd1, Vd2, • • •) outputted by a gray-scale voltage selecting circuit 102 are applied to the drain electrodes. Scan line signals (Vy1, Vy2, • • •) outputted by a scan signal driving circuit 103 are applied to the common electrodes.

Incidentally, in FIG. 1, a capacitor is provided in parallel to each liquid crystal cell. This is intended to stabilize an applied voltage to each liquid crystal cell.

A peripheral circuit includes the following components: The data signal driving circuit 101 for outputting the gray-scale voltage control signals (Vx1, Vx2, • • •), the gray-scale voltage selecting circuit 102 for outputting the gray-scale voltages (Vd1, Vd2, • • •), the scan signal driving circuit 103 for outputting the scan line signals (Vy1, Vy2, • • •), and a voltage waveform generating circuit 104 for generating a voltage waveform (Vramp) becoming the reference.

Here, the gray-scale voltage selecting circuit 102 is divided into blocks the number of which is equal to the number of the scan lines. The respective inputs thereto are Vramp and the scan line signals (Vy1, Vy2, • • •) corresponding to the respective scan lines. The scan line signals (Vy1, Vy2, • • •) are used as select signals.

Also, the liquid crystal display apparatus including the above-described pixels and peripheral circuit in the present embodiment may preferably be a lateral electric field type liquid crystal display apparatus having a plurality of common electrodes and gate electrodes, both of which are intersected respectively, and a plurality of drain electrodes in parallel with the common electrodes, formed on one of in-planes of two substrates oppositely located through a liquid crystal layer.

Also, it is preferable that the above-described pixels and peripheral circuit be formed integrally on one and the same substrate of the two substrates.

Next, referring to FIG. 6, the explanation will be given below concerning the operations of the data signal driving circuit 101, the gray-scale voltage selecting circuit 102, the scan signal driving circuit 103, and the voltage waveform generating circuit 104.

The scan signal driving circuit 103 outputs the scan line signals (Vy1, Vy2, • • •) to the respective common electrodes. Each scan line signal becomes "low" one time in one frame time-period for one scanning time-period. Its output timing is equal to a timing with which a scan line to be scanned in the line sequence scanning is specified. For example, next to a scan line signal Vy1, Vy2 becomes "low" and further, next to Vy2, Vy3 becomes "low".

The data signal driving circuit 101 outputs the gray-scale voltage control signals (Vx1, Vx2, • • •) to the respective gate electrodes. Each gray-scale voltage control signal becomes "high" during a time-period corresponding to gray-scale information of display data on the scan line.

As an example, focusing an attention on a liquid crystal cell 11 in FIG. 1, let's consider the case where the gray-scale information of this pixel is that the degree of the luminance is equal to, for example, 40% (in an arbitrary unit). In this case, during a time-period in which Vy1 is "low", Vx1 becomes "high" only in a time-period of t 40 that corresponds to the gray-scale information of the 40% luminance. Also, focusing an attention on a liquid crystal cell 22, let's consider the case where the gray-scale information is that the luminance of this pixel is equal to 80%. In this case, during a time-period in which Vy2 is "low", Vx2 becomes "high" only in a time-period of t 80 that corresponds to the gray-scale information of the 80% luminance. Incidentally, in the above-described respective occasions when the respective scan line signals (Vy1, Vy2, • • •) are "low" (VcomS) and the respective gray-scale voltage control signals (Vx1, Vx2, • • •) are "high", the gate in each of the N type MOS transistors is switched into the ON state. Also, "high" electric potentials of the respective scan line signals and "high" electric potentials of the respective gray-scale voltage control signals are set in advance so that the former "high" electric potentials become higher than the latter "high" electric potentials.

The voltage waveform generating circuit 104 generates Vramp, i.e., the voltage waveform becoming the reference, to the gray-scale voltage selecting circuit 102. This voltage waveform has, for example, a ramp waveform. An electric potential that is equal to an electric potential of the "low" of the above-described respective scan line signals is defined as a reference electric potential (VcomS) of this ramp waveform. Moreover, this ramp waveform has two types of inclinations that vary from the reference electric potential in a direction of a positive polarity and that of a negative polarity. These two types of ramp waveforms, i.e., Vramp, are outputted every one scanning time-period alternately. Also, when an attention is focused on a certain one scanning time-period (i.e., for example, the time-period in which Vy1 is "low") in one frame, the two types of ramp waveforms are outputted every one frame alternately.

Incidentally, in the present embodiment, a waveform in which the voltage is monotonously increased or decreased with a lapse of time is employed as the ramp waveform. However, the ramp waveform Vramp that is usable in the present invention is not limited thereto. Thus, the configuration is also allowable where a curve-shaped or a step-shaped waveform is used as long as it is varied with an inclination known beforehand.

When the scan line signals as the select signals are "high", the gray-scale voltage selecting circuit 102 outputs the "high" of the respective scan line signals (Vy1, Vy2, • • •) just as it is. Meanwhile, when the scan line signals are "low", the selecting circuit 102 selects and outputs Vramp.

The use of the above-described operations allows the following process to be implemented: When the respective scan line signals (Vy1, Vy2, • • •) are "low" and the respective gray-scale voltage control signals (Vx1, Vx2, • • •) are "high", the gate in each MOS transistor in each liquid crystal cell is switched into the ON state. At this time, an electric potential difference between each of the gray-scale voltages (Vd1, Vd2, • • •) and each of the scan line signals (Vy1, Vy2, • • •) is applied to each liquid crystal cell. Moreover, electric potential differences to which the respective gray-scale voltages attain at the end of the "high" time-periods of the respective gray-scale voltage control signals are held, becoming applied voltages (V40, V80) to each liquid crystal cell until the next frame.

Explaining the above-described process with an example employed, consider the case of the liquid crystal cell 11: When the scan line signal Vy1 is "low" and the gray-scale voltage control signal Vx1 is "high", the gate is switched into the ON state. The gray-scale voltage (Vd1) at this time is applied to the liquid crystal cell. Moreover, the electric potential (which turns out to be V40) to which the gray-scale voltage Vd1 attains at the end of the "high" time-period of the gray-scale voltage control signal Vx1 is held, becoming the applied voltage (V40) to the liquid crystal cell until the next frame. This shows that the gray-scale information 40 about the pixel including the liquid crystal cell 11 is transformed into the liquid-crystal applied voltage V40. Consequently, it is possible to implement the active matrix type liquid crystal display apparatus that allows the applied RMS voltage to each pixel to be controlled in correspondence with the display data.

Additionally, the reason why the two types of ramp waveforms (Vramp) are provided every one scanning time-period alternately is to implement what is called a line inversion driving. The line inversion driving causes a polarity of the liquid-crystal applied voltage to differ between on a line and on a line next thereto. Also, the reason why the two types of ramp waveforms are provided every one frame alternately is to invert the polarity of the liquid-crystal applied voltage for each frame.

Figure 6:
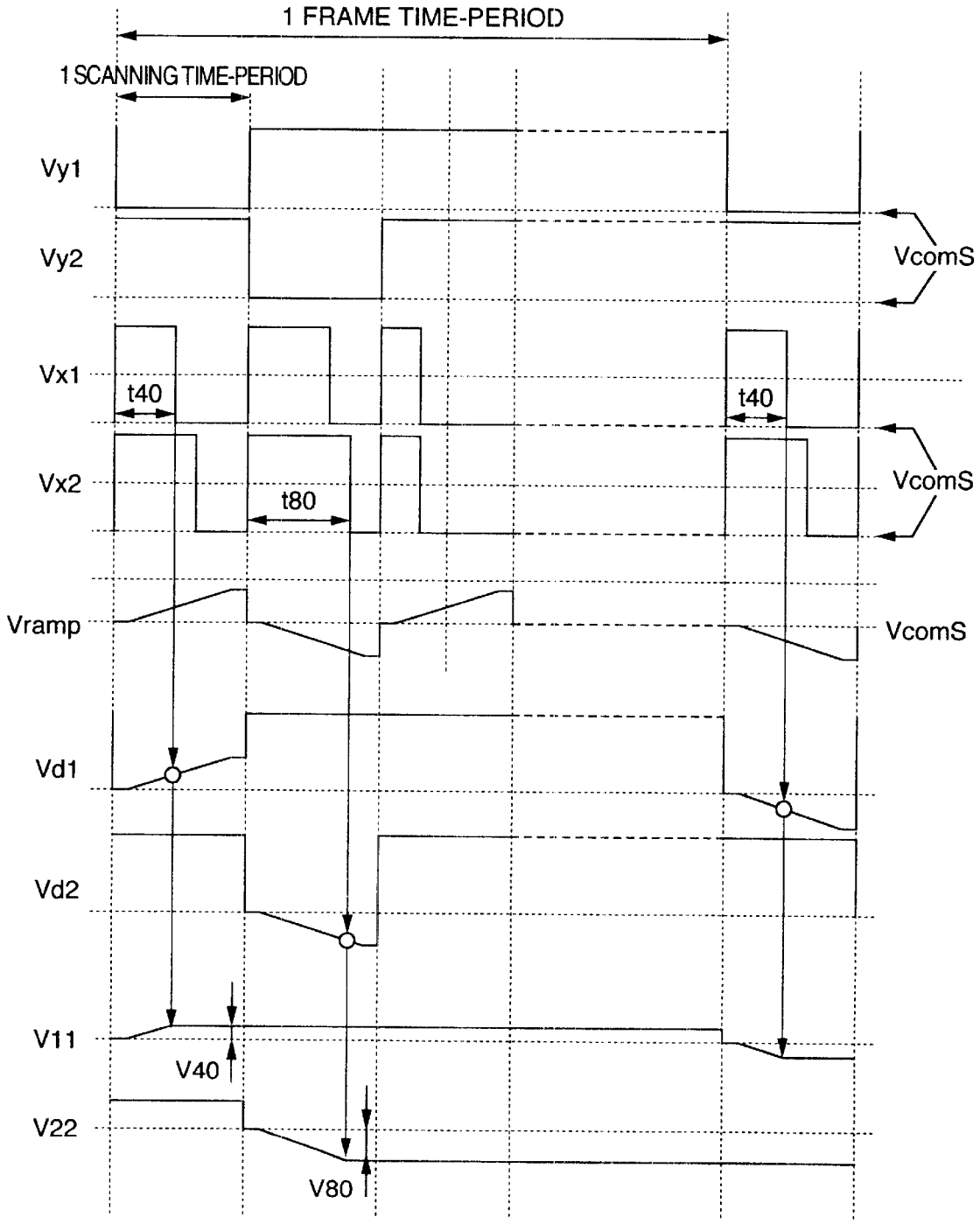
FIG. 6 is a timing chart for illustrating a driving method for the liquid crystal display apparatus related to the first embodiment according to the present invention.

Furthermore, as illustrated in FIG. 6, the gray-scale voltages Vd1, Vd2 are maintained to be constant in the beginning time-period and the ending time-period of the one scanning time-period. In compliance with this, the gray-scale voltage control signals (Vx1, Vx2, • • •) are "high" regardless of the gray-scale information of the display data at the beginning of the one scanning time-period, and the control signals are "low" at the end of the one scanning time-period. The reason for this is that providing a time allowance before and after the one scanning time-period prevents mistakes that occurs due to a delay in the signal and so on. An example of such mistakes is applying the gray-scale voltages Vd1, Vd2 in the beginning time-period and the ending time-period of the one scanning time-period.

Next, referring to FIGS. 7 to 8, the detailed explanation will be given below concerning the configuration and the operation of the data signal driving circuit 101 related to the first embodiment according to the present invention.

Figure 7:
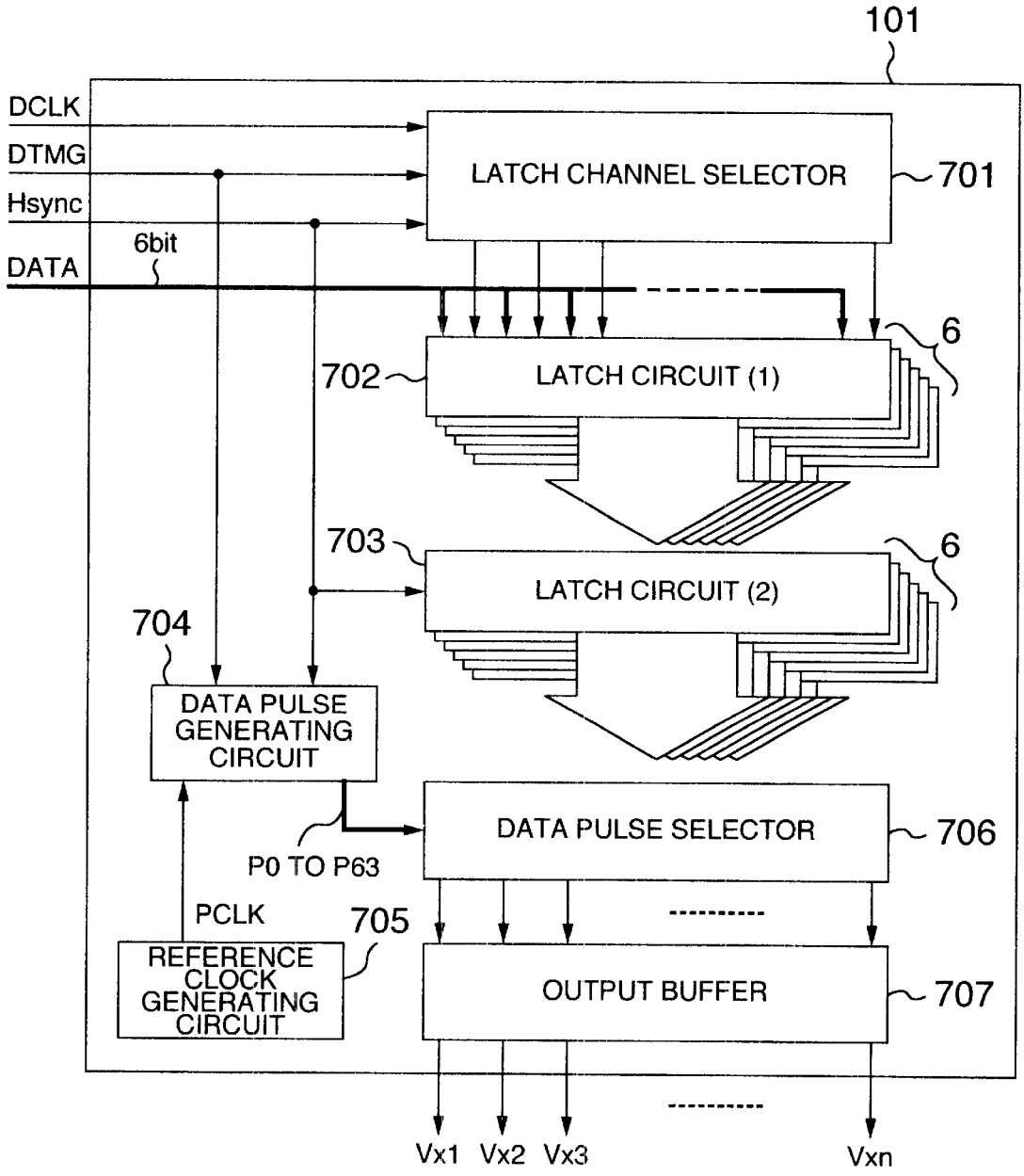
FIG. 7 is a block diagram for illustrating the configuration of a data signal driving circuit related to the first embodiment according to the present invention.
Figure 8:
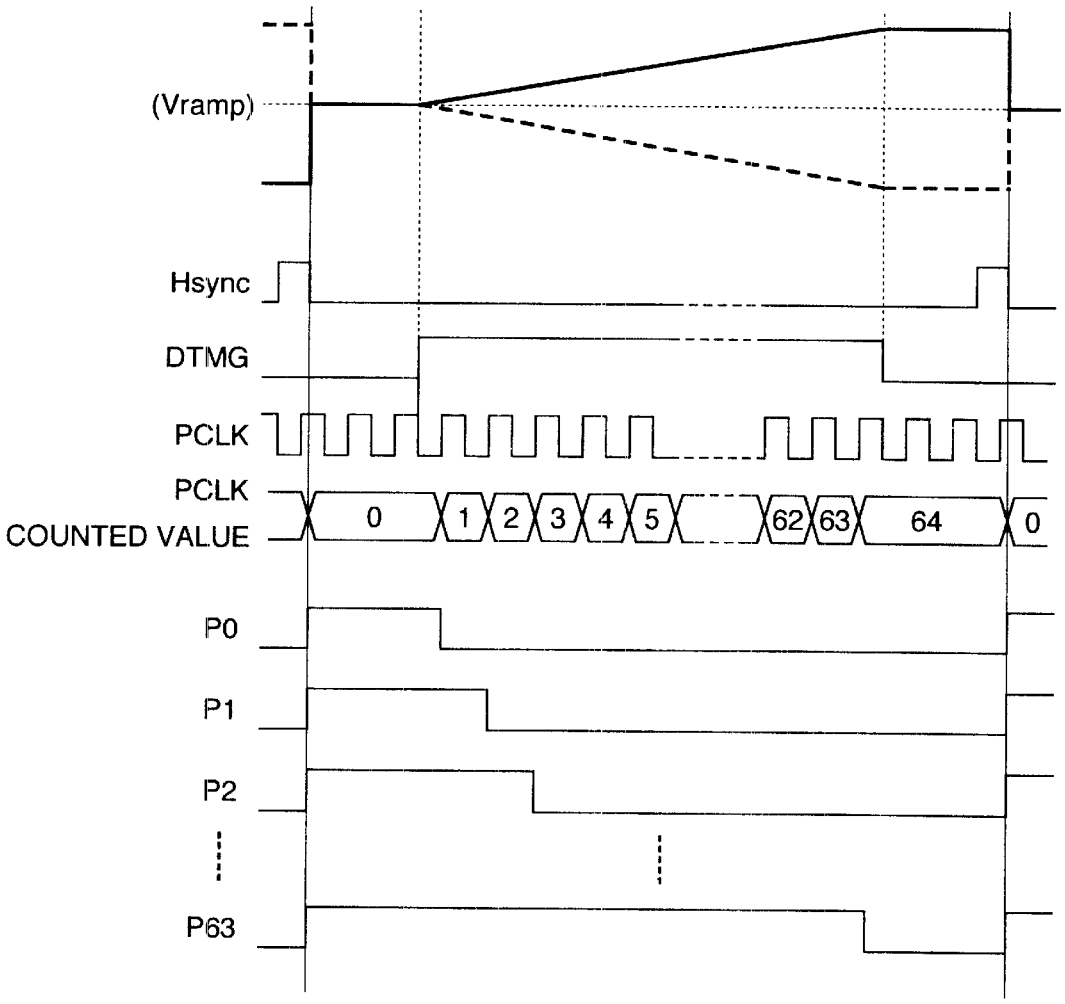
FIG. 8 is a timing chart for illustrating the operation of the data signal driving circuit related to the first embodiment according to the present invention.

At first, FIG. 7 is a block diagram for illustrating the configuration of the data signal driving circuit 101 related to the 1st embodiment according to the present invention. As illustrated in FIG. 7, the input signals into the data signal driving circuit 101 are as follows: DCLK (Dot Clock) in synchronization with transfer of display data, DTMG (Display Timing) for indicating an effective time-period of the display data, HSYNC (Horizontal Sync.) in synchronization with one scanning time-period, and the display data DATA. The display data is assumed to have 6-bit (64 types) gray-scale information. Meanwhile, the outputs therefrom are the above-described gray-scale voltage control signals (Vx1, Vx2, • • •). In the present embodiment, there exist channels corresponding Vx1 to Vxn in response to the resolution in a transverse direction of the liquid crystal display apparatus.

Next, the data signal driving circuit 101 includes the following blocks: A latch channel selector 701 for indicating a channel to latch DATA, a latch circuit (1) 702 and a latch circuit (2) 703 for latching DATA corresponding to Vx1 to Vxn, a data pulse generating circuit 704 for generating 64 types of pulse-width signals P0 to P63 corresponding to the gray-scale information, a reference clock generating circuit 705 for generating a reference clock of the pulse-width signals P0 to P63, a data pulse selector 706 for selecting one pulse-width signal from the 64 types of pulse-width signals P0 to P63, and an output buffer 707.

Next, the explanation will be given below concerning the operations of the respective blocks.

The latch channel selector 701 is reset during a time-period where HSYNC is in an active state, and outputs a channel select signal in synchronization with DCLK during a time-period where DTMG is in an active state. At that time, the latch channel selector 701 operates so that the "high" is shifted in sequence in a direction heading from Vx1 to Vxn.

The latch circuit (1) 702 latches DATA during a time-period where the channel select signal is "high". Based on this operation, the latch circuit (1) 702 latches, over a desired channel, DATA corresponding to Vx1 to Vxn.

The latch circuit (2) 703 latches again an output from the latch circuit (1) 702 during the time-period where HSYNC is in the active state. Based on this operation, the latch circuit (2) 703 simultaneously outputs DATA over all the channels.

The data pulse generating circuit 704 includes a counter and a decoder for generating the pulse-width signals P0 to P63. As illustrated in FIG. 8, the counter is reset during the time-period where HSYNC is in the active state. Moreover, during the time-period where DTMG is in the active state, the counter counts clocks PCLK that are outputted from the reference clock generating circuit 705. Here, the clock frequency of PCLK is set in advance so that the counted value becomes equal to "64" at the end of the time-period where DTMG is in the active state. Based on the counted value of PCLK, the decoder sets the time-period of "high". For example, the counted value 0 in P0, the counted value 0 to 1 in P1, and the counted value 0 to 63 in P63 are set to be "high", respectively.

The data pulse selector 706 selects and outputs one pulse-width signal from the pulse-width signals P0 to P63, depending on the values of DATA over the respective channels outputted by the latch circuit (2) 703. For example, if the DATA value over a certain channel is 100001 (=33), the selector 706 selects and outputs P33 to the channel. Also, if the DATA value over another channel is 000100 (=4), the selector 706 selects and outputs P4 to the channel.

The output buffer 707 converts, into predetermined electric potentials, electric potentials of "high" and "low" of the pulse-width signal outputted by the data pulse selector 706, the predetermined electric potentials satisfying the previously described relation with the electric potentials of the respective scan line signals. Then, the output buffer 707 outputs the predetermined electric potentials as the respective gray-scale voltage control signals.

The above-explained configuration and the operation of the data signal driving circuit 101 makes it possible to implement the waveforms of the gray-scale voltage control signals illustrated in FIG. 6.

Incidentally, the scan signal driving circuit 103 for outputting the scan line signals (Vy1, Vy2, • • •) is reset during a time-period where VSYNC (Vertical Sync.) is in an active state, and outputs a scan line signal in synchronization with HSYNC during the time-period where DTMG is in the active state. At that time, the scan signal driving circuit 103 operates so that the "low" is shifted in sequence in a direction heading from Vy1 to Vyn.

Also, in order to implement the feature described earlier, i.e., the control of maintaining the electric potentials of the respective gray-scale voltages to be constant in the beginning time-period and the ending time-period of the one scanning time-period, the voltage waveform generating circuit 104 generates the ramp waveform Vramp with the inclination only during the time-period where the above-described counter included in the data pulse generating circuit 704 operates (i.e., in the present embodiment, the time-period where DTMG is in the active state). Furthermore, electric potentials to which the respective gray-scale voltages attain at the end of the time-period where DTMG is in the active state are set in advance so that the transmittance of each liquid crystal cell substantially becomes its maximum (or minimum). Setting the electric potentials in this way makes it possible to maximize a dynamic range in the contrast.

As having been described so far, according to the first embodiment in the present invention, the pulse-width of the gray-scale voltage control signal makes it possible to control the transmittance of each liquid crystal cell. Consequently, as compared with the prior art, even if the number of gray-scales is increased, there is less increase in the circuit scale.

Further, according to the first embodiment in the present invention, all the peripheral circuits can be configured using digital circuits. This condition makes it possible to suppress a deterioration in the picture quality caused by a variation in the characteristics of the elements.

Even further, according to the first embodiment in the present invention, the configuration is such that one MOS transistor is located within one pixel. This condition prevents the pixel transmittance and the yield from being decreased.

Next, referring to FIGS. 9 to 11, the explanation will be given below concerning the second embodiment according to the present invention.

The second embodiment according to the present invention provides a method of implementing what is called a dot inversion driving. The dot inversion driving causes a polarity of each of the liquid-crystal applied voltages V40, V80 to differ between in adjacent pixels. The basic concept of the dot inversion driving is as follows: As illustrated in FIG. 9, if a ramp waveform (Vramp) is provided in such a manner that the ramp waveform passes through the reference voltage at an intermediate point in time of one scanning time-period, a polarity of each of the gray-scale voltages Vd1, Vd2 with reference to the reference voltage is inverted between in the first half and in the second half of the one scanning time-period. Moreover, by causing the pulse-width of each of the gray-scale voltage control signals (Vx1, Vx2, • • •) to correspond to which of the first half and the second half of the one scanning time-period, it becomes possible to determine which polarity of each of the gray-scale voltages Vd1, Vd2 is selected out of the mutually inverted polarities. Namely, the way of providing the pulse-width of each of the gray-scale voltage control signals (Vx1, Vx2, • • •) is caused to differ between in the adjacent pixels. This processing makes it possible to implement the dot inversion driving.

Next, the detailed explanation will be given below concerning the configuration and the operation of the second embodiment according to the present invention.

The fundamental configuration of the second embodiment according to the present invention is the same as the configuration of the first embodiment according to the present invention illustrated in FIG. 1. In particular, since the configurations and the operations of the respective pixels, a gray-scale voltage selecting circuit 102, and a scan signal driving circuit 103 are the same as those of the first embodiment according to the present invention, the explanation thereof will be omitted here. Instead, the explanation will be given below mainly concerning a data signal driving circuit 1001 performing a different operation and illustrated in FIG. 10.

Figure 10:
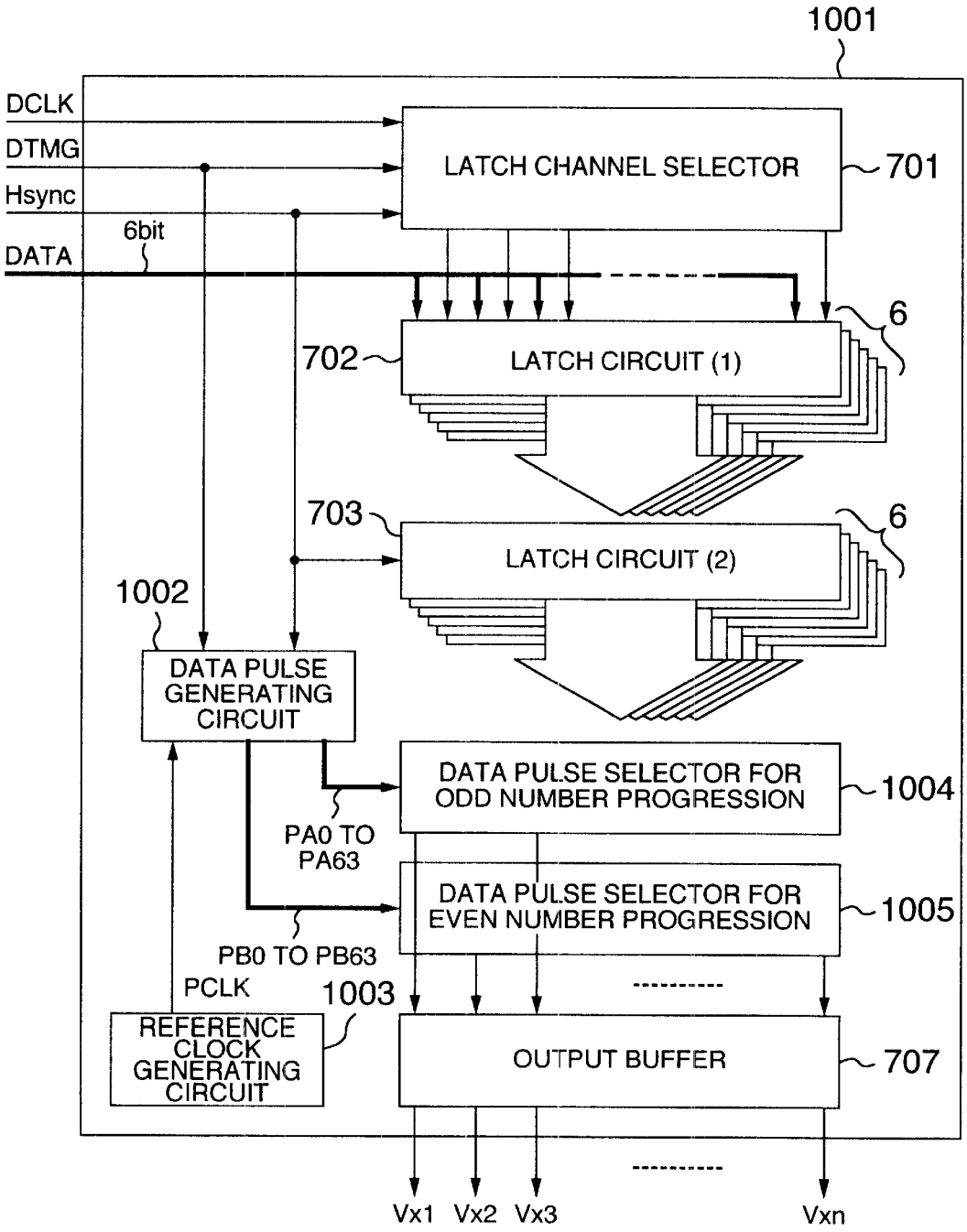
FIG. 10 is a block diagram for illustrating the configuration of a data signal driving circuit related to the second embodiment according to the present invention.
Figure 11:
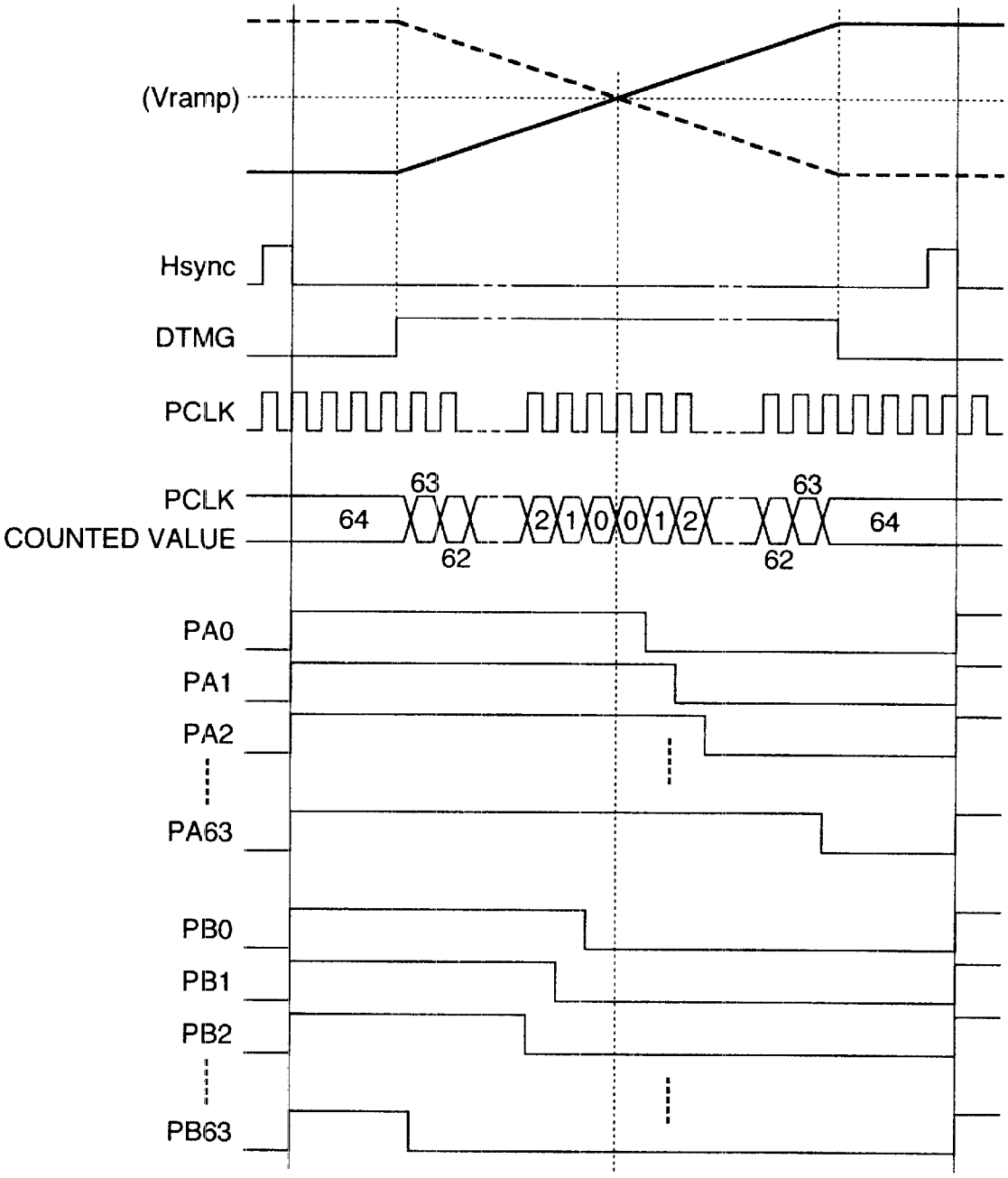
FIG. 11 is a timing chart for illustrating the operation of the data signal driving circuit related to the second embodiment according to the present invention.

FIG. 10 is a block diagram for illustrating the configuration of the data signal driving circuit 1001 related to the second embodiment according to the present invention.

The input signals into the data signal driving circuit 1001 are the same as those into the data signal driving circuit 101 related to the 1st embodiment according to the present invention. Also, in the configuration as well, the following blocks are the same as those of the data signal driving circuit 101 and perform the same operations: A latch channel selector 701 for indicating a channel to latch DATA, a latch circuit (1) 702 and a latch circuit (2) 703 for latching DATA corresponding to the gray-scale voltage control signals Vx1 to Vxn, and an output buffer 707.

The blocks that are different from those of the first embodiment according to the present invention are as follow: A data pulse generating circuit 1002 for generating both of 64 types of pulse-width signals, i.e., PA0 to PA63 and PB0 to PB63 corresponding to the gray-scale information and odd number or even number output channels, a reference clock generating circuit 1003 for generating reference clocks of the pulse-width signals, a data pulse selector 1004 for odd number progression for selecting one pulse-width signal from the 64 types of pulse-width signals PA0 to PA63, and a data pulse selector 1005 for even number progression for selecting one pulse-width signal from the 64 types of pulse-width signals PB0 to PB63.

The data pulse generating circuit 1002 includes a counter and a decoder for generating the pulse-width signals PA0 to PA63 and PB0 to PB63. As illustrated in FIG. 11, the counter is set to be, for example, "64" during the time-period where HSYNC is in the active state. Moreover, during the time-period where DTMG is in the active state, the counter down-counts clocks PCLK (Pulse Clock) outputted from the reference clock generating circuit 1003. In addition, when the counted value becomes equal to "0", the counter switches the counting operation of PCLK into up-count.

Here, the clock frequency of PCLK is set in advance in the following manner: The counted value becomes equal to "0" at a point in time (an intermediate point in time of one scanning time-period) when each of the gray-scale voltages Vd1, Vd2 (FIG. 9) passes through the reference voltage, and the counted value becomes equal to "64" at the end of the time-period where DTMG is in the active state.

Based on the counted value of PCLK, the decoder sets the time-period of "high". For example, the counted value 0 at the time of the up-count in the pulse-width signal PA0, the counted value 0 to 1 in the pulse-width signal PA1, and the counted value 0 to 63 in the pulse-width signal PA63 are set to be "high", respectively. Also, the counted value 1 to 64 at the time of the down-count in the pulse-width signal PB0, the counted value 2 to 64 in the pulse-width signal PB1, and the counted value 64 in the pulse-width signal PB63 are set to be "high", respectively.

The data pulse selector 1004 for odd number progression selects and outputs one pulse-width signal from the pulse-width signals PA0 to PA63, depending on the values of DATA over the odd number channels outputted by the latch circuit (2) 703. For example, if the DATA value over a certain odd number channel is 100001 (=33), the selector 1004 selects and outputs PA33 to the channel. Also, if the DATA value over another odd number channel is 000100 (=4), the selector 1004 selects and outputs PA4 to the channel. Meanwhile, the data pulse selector 1005 for even number progression operates in a similar manner: The selector 1005 selects and outputs one pulse-width signal from the pulse-width signals PB0 to PB63, depending on the values of DATA over the even number channels outputted by the latch circuit (2) 703.

Figure 9:
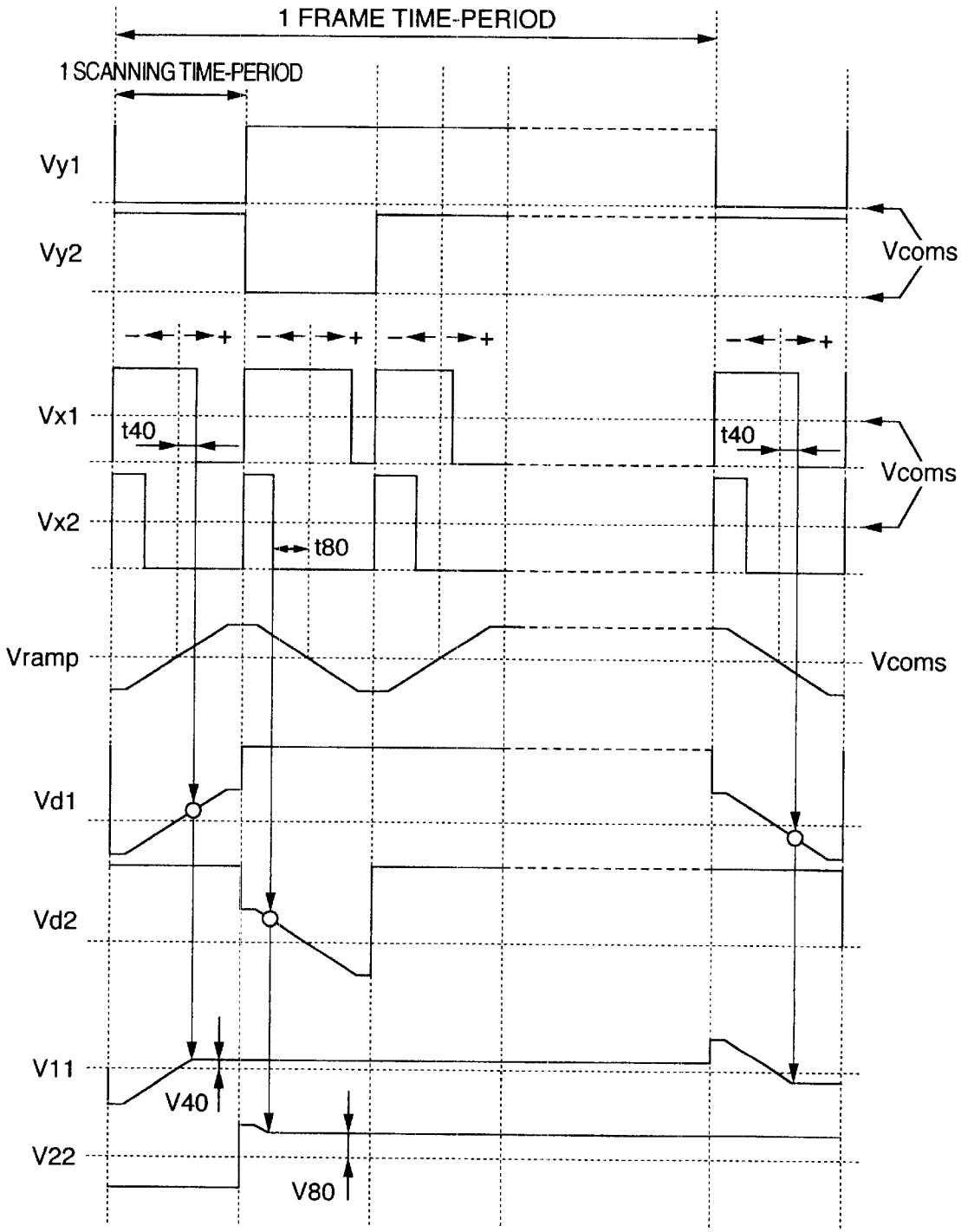
FIG. 9 is a timing chart for illustrating a driving method for a liquid crystal display apparatus related to the second embodiment according to the present invention.

The above-explained configuration and the operation of the data signal driving circuit 1001 makes it possible to implement the waveforms of the gray-scale voltage control signals Vx1, Vx2 illustrated in FIG. 9.

Incidentally, in much the same way as in the voltage waveform generating circuit 104 related to the first embodiment according to the present invention, a voltage waveform generating circuit related to the second embodiment according to the present invention generates the ramp waveform Vramp with the inclination only during the time-period where the counter included in the data pulse generating circuit 1002 operates (i.e., in the present embodiment, the time-period where DTMG is in the active state). Furthermore, electric potentials of the respective gray-scale voltages Vd1, Vd2, to which the ramp waveform Vramp attains at the end of the above-described time-period, are set in advance so that the transmittance of each liquid crystal cell becomes its maximum (or minimum).

As having been described so far, according to the second embodiment in the present invention, in addition to the effects similar to those in the first embodiment in the present invention, what is called a dot inversion driving can be implemented. The dot inversion driving causes a polarity of the liquid-crystal applied voltage to differ between in adjacent pixels. This condition makes it possible to enhance the picture quality and to lower the power consumption even further.

Hereinafter, referring to FIG. 12, the explanation will be given concerning the third embodiment according to the present invention.

The third embodiment according to the present invention provides a method of making the amplitude of the Vramp waveform smaller and causing a polarity of the liquid-crystal applied voltage to differ for each line.

Figure 12:
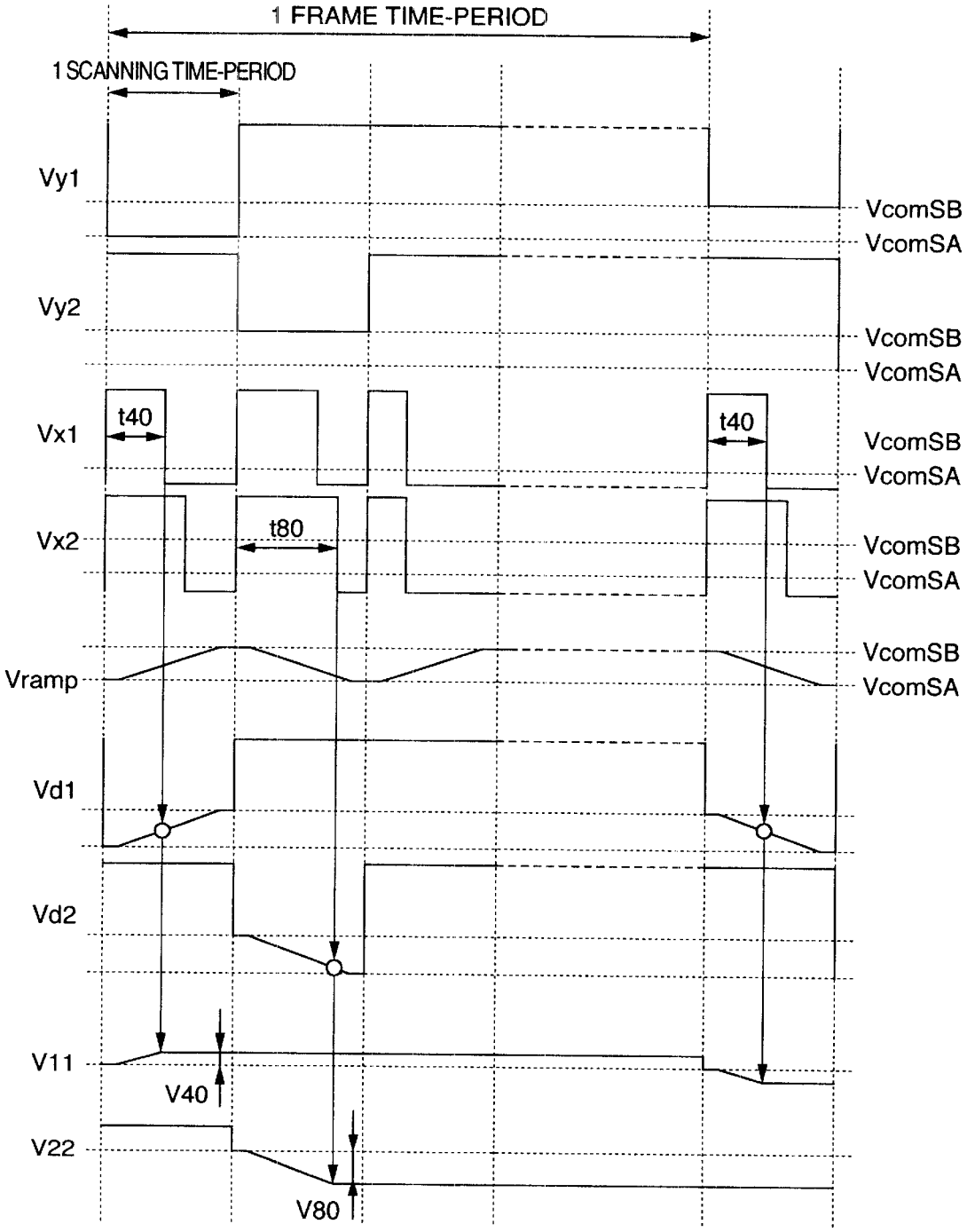
FIG. 12 is a timing chart for illustrating a driving method for a liquid crystal display apparatus related to the third embodiment according to the present invention.

In order to implement this, as illustrated in FIG. 12, there are provided two types (VcomSA, VcomSB) of "low" electric potentials of each scan line signal. These two types of "low" electric potentials are applied for each line alternately. At this time, the electric potential of VcomSA is equal to the reference electric potential VcomS of the ramp waveform Vramp illustrated in FIG. 6. The electric potential of VcomSB is set in advance so that it becomes equal to the electric potential to which the ramp waveform Vramp attains when varying from the reference electric potential into a direction of a positive polarity.

In addition, Vramp is assumed to be a ramp waveform that varies from the reference electric potential VcomSA to VcomSB at a timing with which each scan line signal outputs VcomSA and that, meanwhile, varies from the reference electric potential VcomSB to VcomSA at a timing with which each scan line signal outputs VcomSB.

On account of this operation, VcomSA becomes the reference of a liquid crystal cell in a pixel on a line on which a scan line signal outputs VcomSA. Accordingly, a voltage of a positive polarity (V11) is applied to the liquid crystal cell. In the meantime, VcomSB becomes the reference of a liquid crystal cell in a pixel on a line on which a scan line signal outputs VcomSB. Accordingly, a voltage of a negative polarity (V22) is applied to the liquid crystal cell. The waveforms of these voltages are identical to those of the liquid-crystal applied voltages illustrated in FIG. 6 in the first embodiment according to the present invention.

Incidentally, in the third embodiment according to the present invention, as illustrated in FIG. 12, the output line of the respective reference electric potentials VcomSA, VcomSB is changed for each frame. This is intended to invert the polarity of the liquid-crystal applied voltage.

Also a scan signal driving circuit for outputting each scan line signal, in its fundamental operation, is the same as the scan signal driving circuit 103 in the first embodiment according to the present invention. These scan signal driving circuits 103 differ from each other in the points that, as described earlier, there exists the two types of "low" electric potentials and the two types of "low" electric potentials are switched for each line so as to be outputted.

As having been described so far, according to the third embodiment in the present invention, there are provided the two types of "low" electric potentials of each of the scan line signals (Vy1, Vy2, • • •). This condition, in addition to the effects similar to those in the first embodiment in the present invention, makes it possible to reduce the amplitude of Vramp down to its one-half.

Hereinafter, referring to FIGS. 13 to 14, the explanation will be given concerning the fourth embodiment according to the present invention.

The fourth embodiment according to the present invention provides a method of making it possible to reduce the circuit scale of the data signal driving circuit even further in the liquid crystal display apparatus having a comparatively low resolution.

First, in the above-described data signal driving circuit 101 related to the first embodiment according to the present invention, the display data DATA by the amount of one line are fetched once by the latch circuits 702, 703, then being converted into the gray-scale voltage control signals (Vx1, Vx2, • • •) simultaneously. In contrast to this, the fourth embodiment according to the present invention is characterized by a processing that the conversion into the gray-scale voltage control signals is performed in serial processing every time DATA is transferred.

Figure 13:
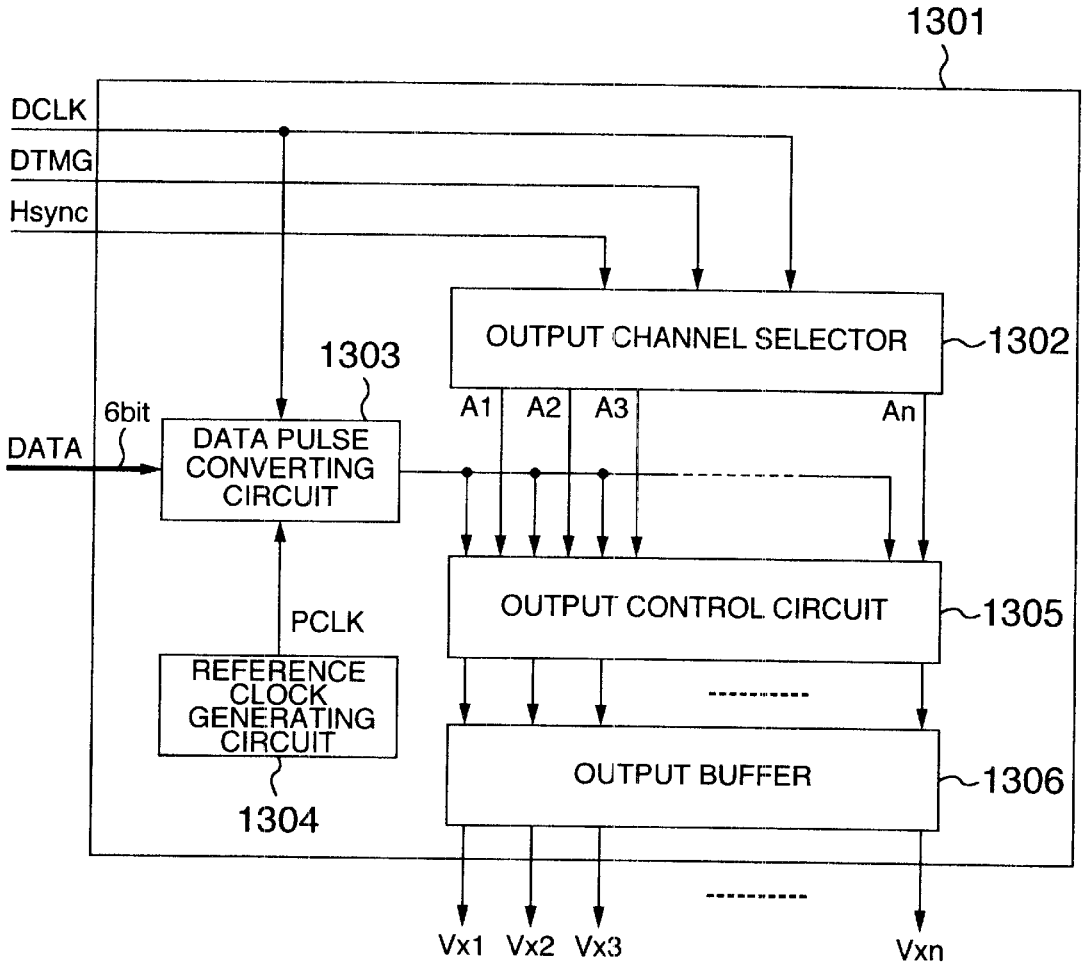
FIG. 13 is a block diagram for illustrating the configuration of a data signal driving circuit related to the fourth embodiment according to the present invention.
Figure 14:
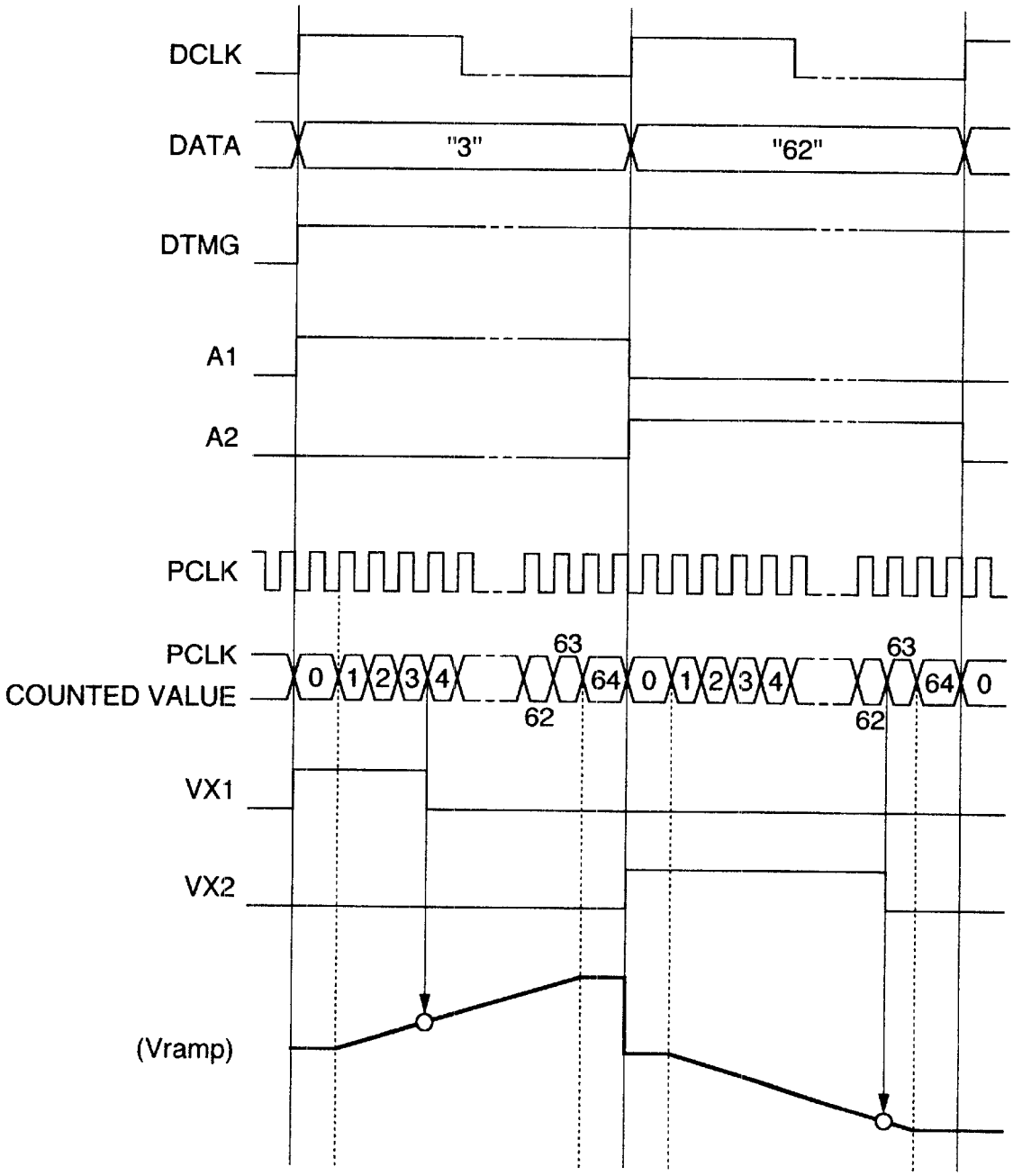
FIG. 14 is a timing chart for illustrating the operation of the data signal driving circuit related to the fourth embodiment according to the present invention.

FIG. 13 is a block diagram for illustrating the configuration of a data signal driving circuit 1301 related to the fourth embodiment according to the present invention. AS illustrated in FIG. 13, the input signals into the data signal driving circuit 1301 are the same as those illustrated in the 1st embodiment according to the present invention.

Next, the data signal driving circuit 1301 includes the following blocks: An output channel selector 1302 for indicating a channel to convert DATA into the gray-scale voltage control signals (Vx1, Vx2, • • •), a data pulse converting circuit 1303 for converting the inputted 6-bit DATA into pulse-width signals P, a reference clock generating circuit 1304 for generating a reference clock of the pulse-width signals P, an output control circuit 1305 for determining an output channel of a pulse-width signal, and an output buffer 1306.

Next, referring to FIG. 14, the explanation will be given below concerning the operations of the respective blocks.

The output channel selector 1302 is reset during the time-period where HSYNC is in the active state, and outputs channel select signals A1 to An in synchronization with DCLK during the time-period where DTMG is in the active state. At that time, the output channel selector 1302 operates so that the "high" is shifted in sequence in the direction heading from Vx1 to Vxn.

The data pulse converting circuit 1303 includes a counter and a decoder for generating the pulse-width signals P. The counter is reset on the rising edge of DCLK, then counting clocks PCLK that are outputted from the reference clock generating circuit 1304. Here, the counter performs no counting operation for several clocks after the reset. Also, the counter operates so that it stops the counting operation when the counted value becomes equal to "64".

Also, the clock frequency of PCLK is set in advance so that the above-described counted value becomes equal to "64", several clocks before from the end of the one scanning time-period. Based on the counted value of PCLK, the decoder sets the time-period of "high" of the pulse-width signals P. For example, the counted value 0 to 3 when DATA is "3", and the counted value 0 to 62 when DATA is "62" are set to be "high", respectively.

When the channel select signals outputted by the output channel selector 1302 are "low", the output control circuit 1305 outputs the "low". Meanwhile, when the channel select signals are "high", the circuit 1305 outputs the pulse-width signals P.

In much the same manner as the output buffers related to the first and the second embodiments according to the present invention, the output buffer 1306 converts electric potentials of "high" and "low" of the signals outputted by the output control circuit 1305 into desired electric potentials as is the case with the first embodiment according to the present invention, then outputting the desired electric potentials as the gray-scale voltage control signals (Vx1, Vx2, • • •).

Summarizing the above-explained operations, the data signal driving circuit 1301 converts the display data DATA into the gray-scale voltage control signals during the time-period equivalent to one period of DCLK, then outputting the gray-scale voltage control signals to the channels (Vx1, Vx2, • • • Vxn) caused to correspond to display positions of the display data DATA.

Additionally, the configuration and the operation of a scan signal driving circuit related to the fourth embodiment according to the present invention are the same as the scan signal driving circuits 102 related to the first and the second embodiments according to the present invention. The scan signal driving circuit 102 is reset during the time-period where VSYNC is in the active state, and outputs a scan line signal in synchronization with HSYNC during the time-period where DTMG is in the active state. At that time, the scan signal driving circuit 102 operates so that the "low" is shifted in sequence in a direction heading from the scan line signal Vy1 to the scan line signal Vyn.

Also, in much the same way as the voltage waveform generating circuit 104 related to the first embodiment according to the present invention, a voltage waveform generating circuit related to the fourth embodiment according to the present invention generates the ramp waveform Vramp with the inclination only during the time-period where the counter included in the data pulse generating circuit 1303 operates. Furthermore, electric potentials of the respective gray-scale voltages Vd1, Vd2, to which the ramp waveform Vramp attains at the end of the above-described time-period, are set in advance so that the transmittance of each liquid crystal cell becomes its maximum (or minimum).

Here, an electric potential that is equal to the electric potential of the "low" (VcomS) of the above-described scan line signals (Vy1, Vy2, • • •) and gray-scale voltage control signals (Vx1, Vx2, • • •) is defined as a reference electric potential of the ramp waveform Vramp. Moreover, the ramp waveform has two types of inclinations that vary from the reference electric potential into a direction of a positive polarity and that of a negative polarity. These two types of ramp waveforms Vramp are outputted every one period of DCLK alternately. Also, when an attention is focused on a certain one period of DCLK alone, the two types of ramp waveforms Vramp are outputted every one frame alternately. This operation makes it possible to implement the dot inversion driving explained in the second embodiment according to the present invention and to convert the liquid-crystal applied voltage every one frame into an alternating voltage.

According to the above-explained fourth embodiment in the present invention, during the time-period where the respective scan line signals are "low", the "high" is outputted in sequence in the direction heading from the gray-scale voltage control signal Vx1 to Vxn. In response to this, the gate in each MOS transistor in each liquid crystal cell is switched into the ON state. At this time, an electric potential difference between each of the gray-scale voltages (Vd1, Vd2, • • •) and each of the scan line signals (Vy1, Vy2, • • •) is applied to each liquid crystal cell. Moreover, electric potential differences to which the respective gray-scale voltages attain at the end of the "high" time-period of each of the gray-scale voltage control signals (Vx1, Vx2, • • •) over each channel are held, becoming applied voltages (V40, V80) to each liquid crystal cell until the next frame. Consequently, it is possible to implement the active matrix type liquid crystal display apparatus that allows the applied RMS voltage to each pixel to be controlled in correspondence with the display data.

Here, in the fourth embodiment according to the present invention, it is required to change the ramp waveform of the respective gray-scale voltages Vd1, Vd2 at a high-speed with the period of DCLK, and PCLK the frequency of which is higher than that of DCLK becomes necessary. For this reason, the fourth embodiment according to the present invention can be said to be suitable for a liquid crystal display apparatus having a low resolution the DCLK frequency of which is comparatively low. However, there can also be considered a method of performing the division driving with the use of, for example, a plurality of the data signal driving circuits 1301 related to the fourth embodiment according to the present invention. In this case, since the PCLK frequency can be decreased, it becomes possible to apply the fourth embodiment to a liquid crystal display apparatus having a higher resolution. consequently, it is preferable to utilize the above-described method, depending on the resolution and the driving frequency of the liquid crystal display apparatus provided.

As having been described so far, according to the fourth embodiment in the present invention, in addition to the effects similar to those in the first embodiment in the present invention, there can be obtained an exceedingly valuable effect of making it possible to reduce the circuit scale of the data signal driving circuit 1301 even further.

In the above-described first to the fourth embodiments according to the present invention, although the waveform of each of the respective gray-scale voltages Vd1, Vd2 is defined as the ramp waveform, the waveform of Vd1, Vd2 is not limited thereto. Thus, the configuration is also allowable where an inclination such as the one of a curve except for a straight line is provided in correspondence with the applied voltage-transmittance characteristic of each liquid crystal cell. Also, in order to present the effect similar to this, the configuration is also allowable where the pulse-width of each of the gray-scale voltage control signals (Vx1, Vx2, • • •) is not determined linearly by the counted value of PCLK but is set by taking into consideration characteristics such as the γ characteristic as well.

Also, when providing a color liquid crystal display apparatus to which the present invention has been applied, it is preferable to set the waveform of each of the gray-scale voltages Vd1, Vd2 or the pulse-width of each of the gray-scale voltage control signals (Vx1, Vx2, • • •) that is different for each of R(red), G(green), and B(blue).

Also, the liquid crystal display apparatus and the driving method therefor according to the present invention are applicable to an amorphous silicon TFT liquid crystal used widely at present. In order to enhance the effects of the present invention, however, it is desirable to apply them to a low temperature polysilicon TFT liquid crystal that allows the peripheral circuit and the pixels to be formed integrally.

Also, the configuration of the liquid crystal display apparatus according to the present invention is that the common electrodes are separated for each scan line. This configuration is provided with a characteristic constitution that is common to the common electrode configuration in the IPS LCD (i.e., in-plane switching type liquid crystal display apparatus) described in Asia Display '95 Digest, pp. 707–710 published by Society for Information Display (SID). Accordingly, the present invention exhibits an advantageous effect that it is applicable to the IPS LCD easily.

According to the present invention, in the active matrix type liquid crystal display apparatus that controls the transmittance (luminance) of each pixel by the RMS voltage applied thereto, the pulse-width of the gray-scale voltage control signal makes it possible to control the transmittance of each liquid crystal cell. Consequently, even if the number of gray-scales is increased, there is little increase in the circuit scale.

Further, according to the present invention, all the peripheral circuits in the liquid crystal display apparatus can be configured using digital circuits. This condition makes it possible to suppress a deterioration in the picture quality caused by a variation in the characteristics of the elements.

Even further, according to the present invention, the configuration is such that one MOS transistor is located within one pixel. This condition prevents the pixel transmittance and the yield from being decreased.

Also, according to the present invention, what is called a dot inversion driving can be implemented. The dot inversion driving causes a polarity of the liquid-crystal applied voltage to differ between in adjacent pixels. This condition makes it possible to enhance the picture quality and to lower the power consumption.

Further, according to the present invention, in the liquid crystal display apparatus having a comparatively low resolution, it is possible to reduce the circuit scale of the data signal driving circuit.

What is claimed is:

1. An active matrix type liquid crystal display apparatus comprising:

a plurality of common electrodes and a plurality of gate electrodes, both of which are intersected respectively, and a plurality of drain electrodes in parallel with said common electrodes, formed on one of inner surfaces of two substrates oppositely arranged through a liquid crystal layer;

a display pixel unit having a plurality of pixels, each of which includes a three-terminal switching element and a liquid crystal cell at each of intersection points of said plurality of common electrodes and said plurality of gate electrodes; and a peripheral circuit for applying a predetermined voltage to each of said common electrode, said gate electrode and said drain electrode;

wherein a first terminal of said switching element is connected to said drain electrode;

a second terminal of said switching element is connected to said liquid crystal cell an opposite side of which is connected to said common electrode; and a third terminal of said switching element is connected to said gate electrode;

whereby said switching element is switched into an ON state when an electric potential difference between a voltage applied to said gate electrode and a voltage applied to said common electrode becomes a predetermined value;

an electric potential difference between a voltage applied to said drain electrode and said voltage applied to said common electrode is applied to said liquid crystal cell in the ON state of said switching element; and an electric potential difference applied at an end of the ON state of said switching element is held until a next ON state;

wherein said peripheral circuit includes:

a scan signal driving circuit for applying an active state of a scan line signal indicative of a scan line to said common electrode in sequence on one scanning time-period basis;

a gray-scale voltage circuit for applying a gray-scale voltage to said drain electrode; and a data signal driving circuit for applying, to said gate electrode, a gray-scale voltage control signal having a pulse-width in accordance with gray-scale information as display data of a pixel applied by the active state of the scan line signal;

said gray-scale voltage circuit includes:

a voltage waveform generating circuit for generating a voltage, a waveform of which is varied with a time predetermined by a characteristic; and a plurality of gray-scale voltage selecting circuits arranged on each of scan lines for applying, to said drain electrode, the voltage waveform generated by said voltage waveform generating circuit for a time-period corresponding to the pulse-width of the gray-scale voltage control signal in a case where the scan line has been selected.

2. The active matrix type liquid crystal display apparatus as claimed in claim 1, wherein said display pixel unit and said peripheral circuit are formed integrally on said substrate.

3. The active matrix type liquid crystal display apparatus as claimed in claim 1, wherein the gray-scale voltage applied to said drain electrode by said gray-scale voltage circuit indicates a different polarity in cases of a first half and a second half in the one scanning time-period;

the pulse-width of the gray-scale voltage control signal applied to said gate electrode by said data signal driving circuit is generated during a time-period of one of the first half and second half in the one scanning time-period; and the time-period is different in the adjacent gate electrodes.

4. The active matrix type liquid crystal display apparatus as claimed in claim 1, wherein electric potentials for two types active states are provided as said scanning line signal applied to said common electrode by said scan signal driving circuit; and the types electric potentials are applied to each of the scan lines.

5. The active matrix type liquid crystal display apparatus as claimed in claim 1, wherein said gray-scale voltage of said voltage waveform generating circuit is one of a ramp waveform and a waveform having a characteristic curve corresponding to an applied voltage to transmittance characteristic of said liquid crystal cell.

6. The active matrix type liquid crystal display apparatus as claimed in claim 1, wherein said gray-scale voltage circuit provides two symmetrical waveforms as gray-scale voltages to change to a positive polarity and a negative polarity from a reference electrical potential;

the two types of the waveforms are outputted at every one scanning time-period alternately;

the two types of the waveforms are outputted every one frame in a case where the one scanning time- period contains one frame; and the electric potentials are constant at both a start and an end of the one scanning time-period.

* * * * *